US012569905B2

(12) United States Patent
Sugihara

(10) Patent No.: US 12,569,905 B2
(45) Date of Patent: Mar. 10, 2026

(54) TOOL AND BINDING MACHINE

(71) Applicant: MAX CO., LTD., Tokyo (JP)

(72) Inventor: Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 416 days.

(21) Appl. No.: 17/942,768

(22) Filed: Sep. 12, 2022

(65) Prior Publication Data

US 2023/0083035 A1 Mar. 16, 2023

(30) Foreign Application Priority Data

Sep. 13, 2021 (JP) ..... 2021-148964

(51) Int. Cl.
*B21F 7/00* (2006.01)

(52) U.S. Cl.
CPC ..... *B21F 7/00* (2013.01)

(58) Field of Classification Search
CPC ..... B21F 15/00; B21F 15/02; B21F 15/04; B65B 13/22; B65B 13/28; B65B 13/285; B65B 13/025; B65B 13/04; B65B 13/06; B65B 27/10; B25B 25/00; E04G 21/123
See application file for complete search history.

(56) References Cited

U.S. PATENT DOCUMENTS

| | | | |
|---|---|---|---|
| 5,678,613 | A | 10/1997 | Murayama et al. |
| 2015/0290791 | A1 | 10/2015 | Takahashi et al. |
| 2018/0187434 | A1 | 7/2018 | Itagaki et al. |
| 2019/0249447 | A1 | 8/2019 | Itagaki et al. |
| 2021/0010282 | A1 | 1/2021 | Itagaki et al. |
| 2021/0178454 | A1 | 6/2021 | Mizuno et al. |
| 2021/0180347 | A1 | 6/2021 | Mizuno et al. |
| 2021/0245229 | A1 | 8/2021 | Yoshida et al. |
| 2024/0337119 | A1 | 10/2024 | Itagaki et al. |

FOREIGN PATENT DOCUMENTS

| | | | |
|---|---|---|---|
| CN | 204748551 | U | 11/2015 |
| CN | 111483640 | A | 8/2020 |
| DE | 102020133389 | A1 | 6/2021 |
| FR | 2624248 | A1 | 6/1989 |

(Continued)

OTHER PUBLICATIONS

Translation of JP-2016124051 (Year: 2016).*
Extended European Search Report for EP Application No. 22195068.6 dated Jan. 2, 2023. (10 pp.).

*Primary Examiner* — Bobby Yeonjin Kim
(74) *Attorney, Agent, or Firm* — Banner & Witcoff, Ltd.

(57) ABSTRACT

A tool includes: a main body includes an output section provided on a front end portion in a longitudinal direction and accommodating a driving unit for driving the output section therein; a gripping unit provided on a lower surface side of the main body; a first hook attachment unit located on an upper surface side of the main body and to allows a hook opened at one side attached; and a second hook attachment unit located on a side surface side of the main body and allows the hook attached. The hook is attached to the first hook attachment unit so that an opening of the hook faces the front side in the longitudinal direction of the main body. The hook is attached to the second hook attachment unit so that the opening of the hook faces the lower side in an upper-lower direction.

8 Claims, 17 Drawing Sheets

(56) References Cited

FOREIGN PATENT DOCUMENTS

| | | | | |
|---|---|---|---|---|
| GB | 2213757 | A | | 8/1989 |
| JP | H09-165918 | A | | 6/1997 |
| JP | H09-225861 | A | | 9/1997 |
| JP | 2004237419 | A | | 8/2004 |
| JP | 2004-332494 | A | | 11/2004 |
| JP | 2006-150503 | A | | 6/2006 |
| JP | 2006181709 | A | | 7/2006 |
| JP | 2009-028841 | A | | 2/2009 |
| JP | 3155762 | U | | 12/2009 |
| JP | 4877488 | B2 | | 2/2012 |
| JP | 2016124051 | A | * | 7/2016 |
| JP | 2019107711 | A | | 7/2019 |
| JP | 2020019531 | A | | 2/2020 |
| JP | 2021127568 | A | | 9/2021 |
| WO | 2008-024049 | A1 | | 2/2008 |

* cited by examiner

TOOL AND BINDING MACHINE

CROSS-REFERENCE TO RELATED APPLICATION(S)

This application is based on and claims priority under 35 USC119 from Japanese Patent Application No. 2021-148964 filed on Sep. 13, 2021, the contents of which are incorporated herein by reference.

TECHNICAL FIELD

The disclosure relates to a tool and a binding machine.

BACKGROUND ART

Some tools such as a reinforcing bar binding machine, a nailing machine and a screw fastener may have a hook attached to a tool body or a grip. This hook can be used to hook the tool on a belt mounted on worker's trousers when the tool is not used or when the tool is carried, or can be used to hook the tool on a scaffold or a stepladder placed on the site or the like when the tool is not used.

For example, PTL 1 describes a screw fastener in which a pair of upper and lower insertion holes are formed on a side surface of a head portion and a hook device is attached to the insertion holes. Further, PTL 2 describes a driving tool in which a hook support member is fixed to a rear portion of a grip formed at one end of a body and a hook formed by connecting a hook portion and a slide shaft portion in a bent shape is attached to this hook support member.

By the way, for example, at a work site where a bar arrangement work for arranging reinforcing bars on a wall or a pillar or the like, and a binding work for binding the arranged reinforcing bars with a wire are performed, when the bar arrangement work and the binding work are alternately performed, a tool (reinforcing bar binding machine) is often hung on a worker's belt or is placed on a scaffold during the bar arrangement work. However, rather than hanging the tool on the belt or placing the tool on the scaffold, it is advantageous in terms of work efficiency to hook the tool on the arranged reinforcing bars because the next work (binding work) can be smoothly performed.

CITATION LIST

Patent Literature

[PTL 1] JP2006-150503A
[PTL 2] JP4,877,488B

However, when the hook is attached to the side surface of the main body so that the opening of the hook faces the front (of the main body) as in the tool disclosed in PTL 1, there is a problem that when the worker hooks the tool on the reinforcing bar or the like according to the orientation of the opening of the hook and releases his hand, the tool is significantly titled and becomes unstable, and the tool easily falls from the reinforcing bar. Further, since the tool is significantly tilted (moved) when the worker releases his hand from the tool, there is a problem that the tool easily comes into contact with the surrounding reinforcing bar or the like, and the surrounding reinforcing bar and the tool itself are damaged.

Further, in the tool disclosed in PTL 2, the hook is provided on the lower side of the gripping unit. Therefore, when hooking the hook on the reinforcing bar or the stepladder or the like, there is a problem that the worker needs to hook the hook while turning over his wrist, which was difficult to execute, and the worker cannot proceed the next work quickly.

SUMMARY

The disclosure has been made to solve the above problems, and an object thereof is to provide a tool and a binding machine that are easily hooked on a hooked member such as a reinforcing bar at a work site and are not significantly tilted when hooked.

A tool according to the disclosure includes a main body including an output section provided on a front end portion in a longitudinal direction and accommodating a driving unit for driving the output section therein, a gripping unit provided on a lower surface side of the main body, a first hook attachment unit located on an upper surface side of the main body and configured to allow a hook opened at one side attached, and a second hook attachment unit located on a side surface side of the main body and configured to allow the hook attached. The hook is attached to the first hook attachment unit so that an opening of the hook faces the front side in the longitudinal direction of the main body, and the hook is attached to the second hook attachment unit so that the opening of the hook faces the lower side in an upper and lower direction of the main body.

A first binding machine according to the disclosure includes a main body including a binding unit for binding a wire provided on a front end portion in a longitudinal direction and accommodating a driving unit for driving the binding unit therein, an accommodation unit provided on a lower surface side of the main body and accommodating the wire, the accommodation unit configured to send out the wire, a gripping unit provided on the lower surface side of the main body and on the rear of the accommodation unit, and a hook attachment unit located on an upper surface side of the main body and configured to allow a hook opened at one side attached. The hook is attached to the hook attachment unit so that an opening of the hook faces the front side in the longitudinal direction of the main body.

A second binding machine according to the disclosure includes a main body including a binding unit for binding a wire provided on a front end portion in a longitudinal direction and accommodating a driving unit for driving the binding unit therein, an accommodation unit provided on a lower surface side of the main body and accommodating the wire, the accommodation unit configured to send out the wire, and a gripping unit provided on the lower surface side of the main body and on the rear of the accommodation unit. The binding machine includes a hook attachment unit located on a side surface side of the main body and configured to allow a hook opened at one side attached, and the hook is attached to the hook attachment unit so that an opening of the hook faces a center of gravity of the binding machine.

A third binding machine according to the disclosure includes a main body including a binding unit for binding a wire provided on a front end portion in a longitudinal direction and accommodating a driving unit for driving the binding unit therein, an accommodation unit provided on a rear end portion in the longitudinal direction of the main body and accommodating the wire, the accommodation unit configured to send out the wire, a gripping unit provided on a lower surface side of the main body, and a hook attachment unit located on an upper surface side of the main body and configured to allow a hook opened at one side attached. The hook is attached to the hook attachment unit so that an opening of the hook faces the front side in the longitudinal direction of the main body.

DESCRIPTION OF EMBODIMENTS

Hereinafter, preferred embodiments of the disclosure will be described in detail with reference to the accompanying drawings.

First Embodiment

Configuration Example of Reinforcing Bar Binding Machine 1A

Figure 1:
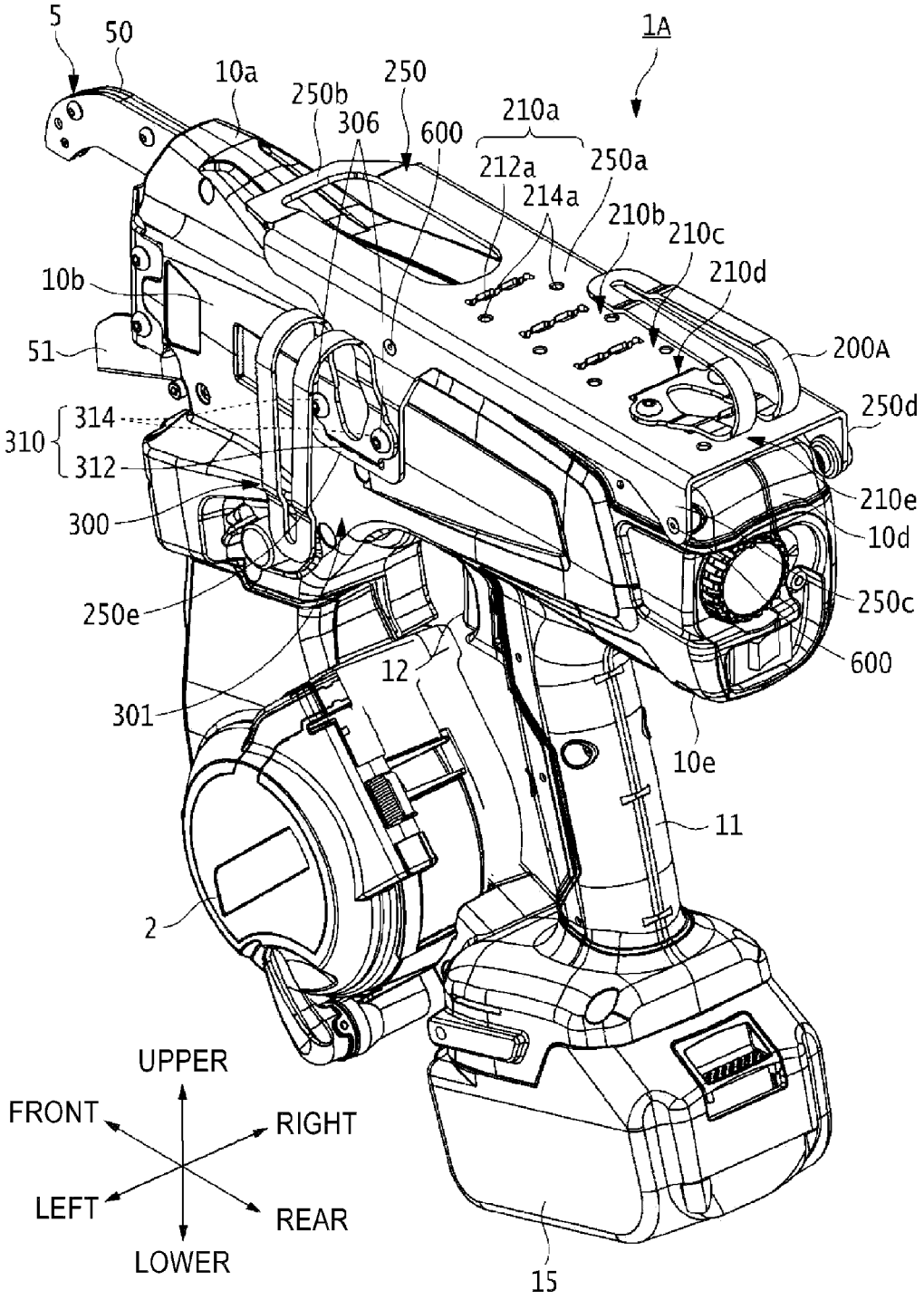
FIG. 1 is a perspective view of a reinforcing bar binding machine according to a first embodiment as viewed from the rear side of the left surface.
Figure 2:
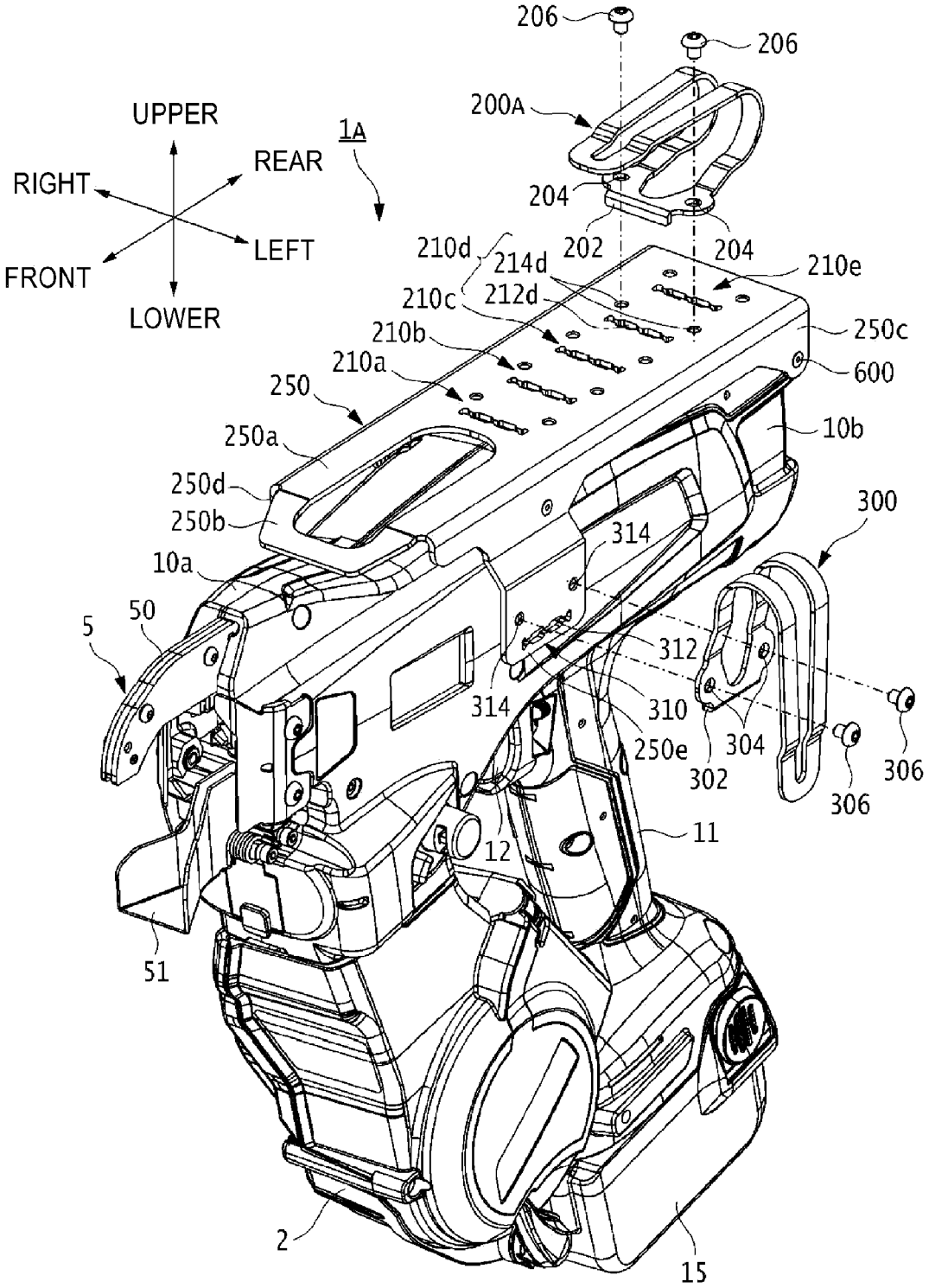
FIG. 2 is an exploded perspective view of the reinforcing bar binding machine according to the first embodiment as viewed from the front side of the left surface.
Figure 3:
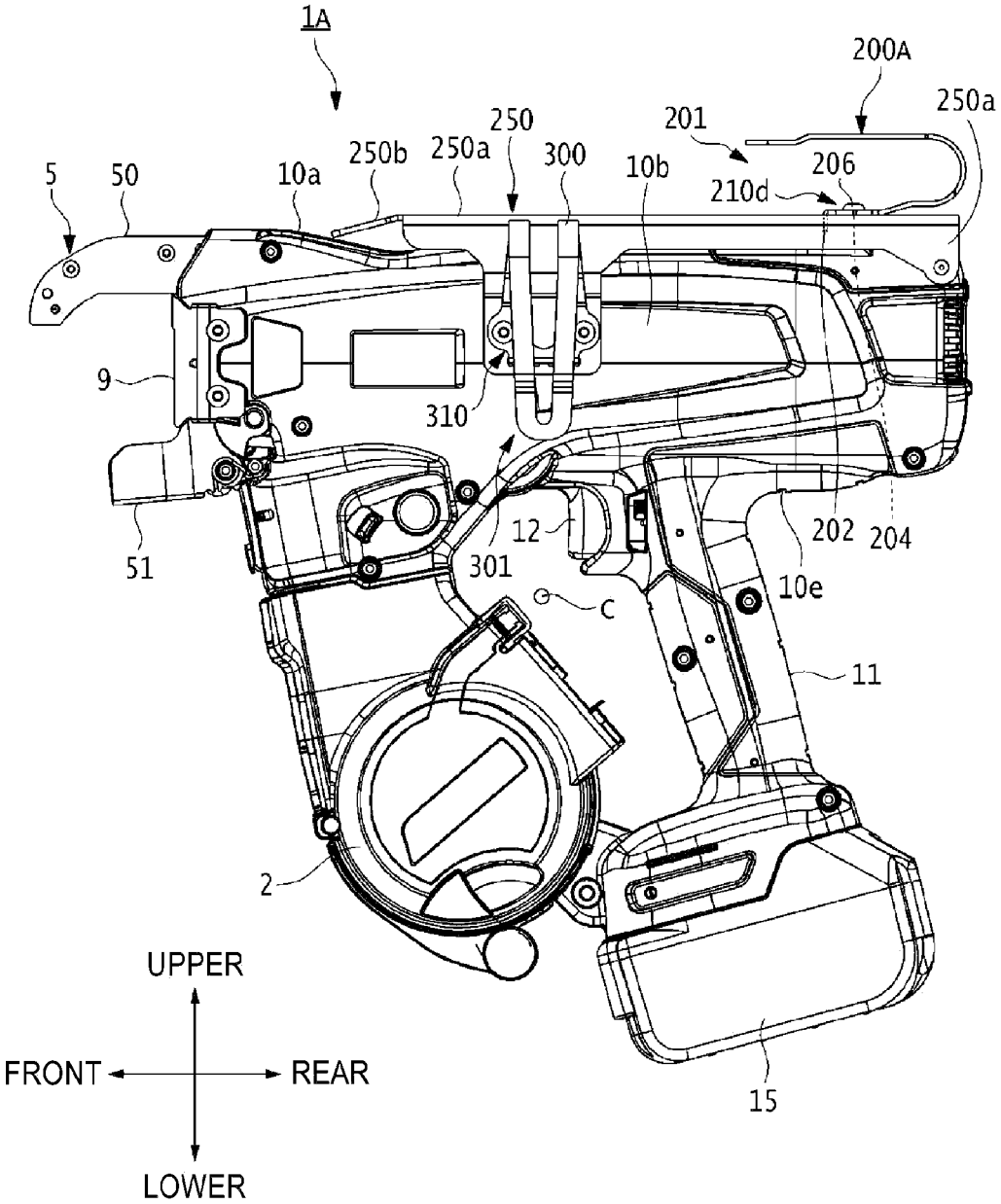
FIG. 3 is a left side view of the reinforcing bar binding machine according to the first embodiment.
Figure 4:
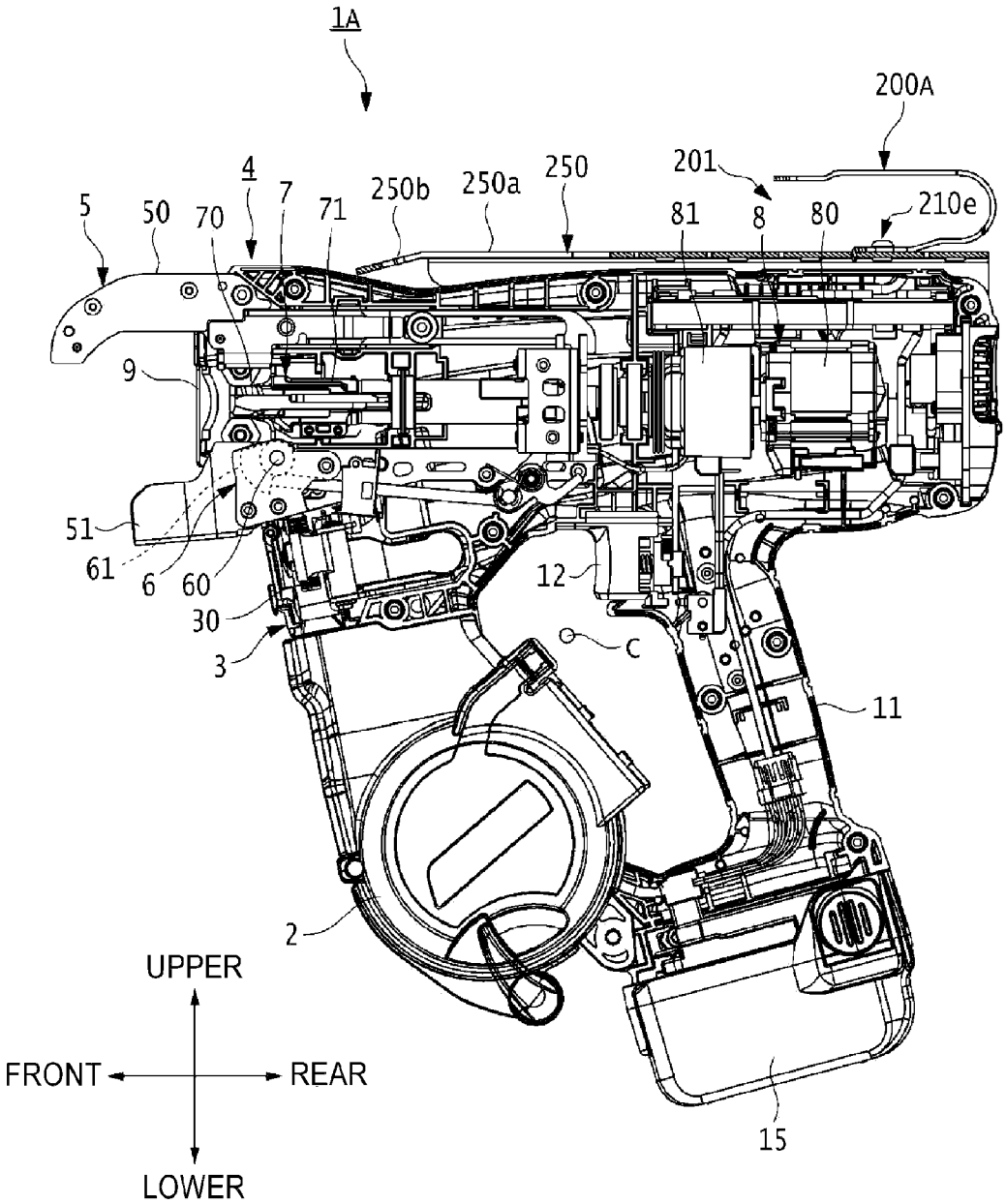
FIG. 4 is a view in which a part of a cover of the reinforcing bar binding machine according to the first embodiment is removed.
Figure 5:
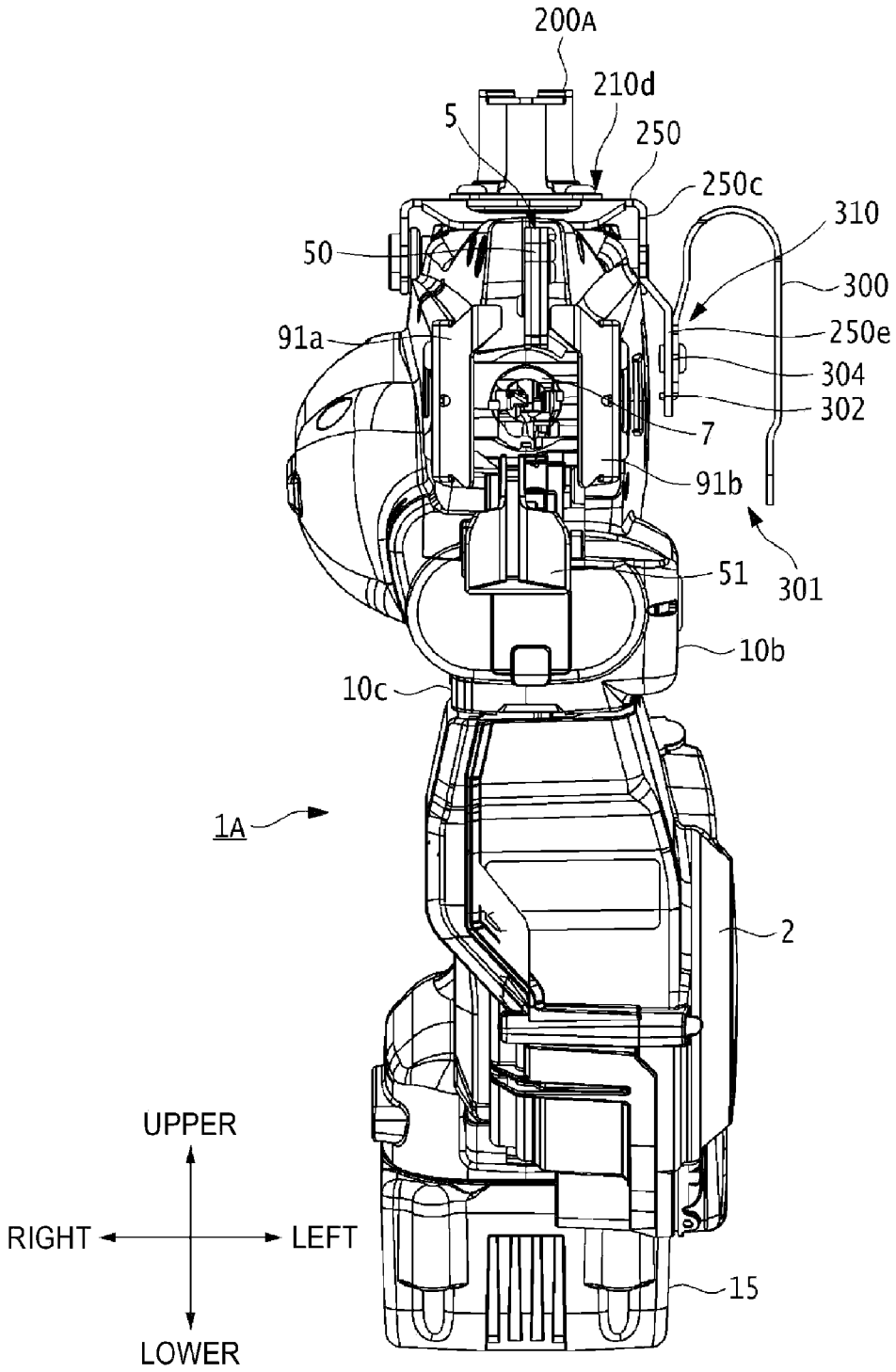
FIG. 5 is a front view of the reinforcing bar binding machine according to the first embodiment.

FIG. 1 is a perspective view of a reinforcing bar binding machine 1A according to a first embodiment as viewed from the rear side of the left surface thereof, and FIG. 2 is an exploded perspective view of the reinforcing bar binding machine 1A as viewed from the front side of the left surface. FIG. 3 is a left side view of the reinforcing bar binding machine 1A according to the first embodiment, FIG. 4 is a view in which a part of a cover of the reinforcing bar binding machine 1A is removed, and FIG. 5 is a front view of the reinforcing bar binding machine 1A according to the first embodiment. Meanwhile, the reinforcing bar binding machine 1A is an example of a tool or a binding machine, and the reinforcing bar binding machine 1A may be referred to as a tool or a binding machine in this specification.

The reinforcing bar binding machine 1A includes a main body 10 configured by a substantially rectangular parallelepiped housing. A binding unit (output section) 4 is provided on one end side (front end portion) in a longitudinal direction of the main body 10, and a driving unit 8 for driving the binding unit 4 is housed inside the main body 10. Further, the reinforcing bar binding machine 1A includes a magazine (accommodation unit) 2 for accommodating a wire W so that the wire W can be sent out on one end side in a width direction (direction orthogonal to the longitudinal direction) of the main body 10, that is, on a lower surface 10*e* side of the main body 10, and a gripping unit 11 on the lower surface 10*e* side of the main body 10 and on the rear side (in the longitudinal direction) of the magazine 2. The binding unit 4 includes a curl forming unit 5 provided to protrude from a front end portion of the main body 10 and configured to give a curl to the wire W sent from the magazine 2, and a twisting unit 7 for twisting the wire W having the curl made by the curl forming unit 5.

The reinforcing bar binding machine 1A includes a first hook attachment unit 210 (210*a* to 210*e*) which is located on an upper surface 10*a* side of the main body 10 (the side opposite to the lower surface 10*e* side via the main body 10) and to which a U-shaped hook 200A opened at one side can be attached, and a second hook attachment unit 310 which is located on a left surface 10*b* side of the main body 10 and to which a hook 300 can be attached. Meanwhile, in the present embodiment, the upper surface 10*a* side means that, in addition to the upper surface 10*a* of the main body 10, the vicinity of the boundary between the upper surface 10*a* of the main body 10 and the left surface 10*b*, a right surface 10*c*, or a rear end surface is included.

The reinforcing bar binding machine 1A includes a cover unit 250 provided to cover at least a part of the upper surface 10*a* of the main body 10 along a front and rear direction (longitudinal direction). The cover unit 250 has a guide surface 250*a* for guiding a reinforcing bar (hooked member) S to an opening 201 of the first hook 200A when the reinforcing bar S is hooked on the first hook 200A attached to the first hook attachment unit 210*a* and the like.

As shown in FIGS. 1 to 5 and the like, the magazine 2 is located relatively in front of the main body 10 and extends downward from the lower surface 10*e* of the main body 10. In the magazine 2, a reel 20 around which the elongated wire W is wound to be releasable is rotatably and detachably stored. As the wire W, in addition to a wire made of a metal wire that can be plastically deformed, a wire obtained by coating a metal wire with a resin, a stranded wire, and the like is used.

The gripping unit 11 is a portion for the worker to grip during work or transportation, and is provided on the lower surface 10*e* side of the main body 10. The gripping unit 11 is provided to face the magazine 2 on the rear side of the magazine 2, and extends downward from the lower surface 10*e* of the main body 10. At the front base end portion of the gripping unit 11, a trigger 12 is provided for the worker to perform an on/off action of a binding work. Meanwhile, the execution of the binding work may be combined with the operation of a contact switch 9 provided at the tip end portion of the main body 10. The gripping unit 11 has a battery attachment portion at the lower tip end portion, to which a battery 15 can be removably attached.

As shown in FIGS. 1 and 2 and the like, the cover unit 250 is formed of an elongated flat plate member having a substantially inverted C-shaped cross section and extending in the front and rear direction, and covers substantially the entire of the upper surface 10*a* of the main body 10. The side of the upper surface of the cover unit 250 is configured as the guide surface 250*a* for slidably guiding the reinforcing bar S from the front of the main body 10 toward the inside of the opening 201 of the first hook 200A. On the front end side of the cover unit 250, an inclined surface 250*b* that is continuous with the guide surface 250*a* and is inclined to gradually rise from the front toward the rear is provided. When the first hook 200A is hooked on the reinforcing bar S, the inclined surface 250*b* picks up the reinforcing bar S and guides the reinforcing bar S into the opening 201 of the first hook 200A.

The cover unit 250 has a left portion 250*c* and a right portion 250*d* erected downward from both ends in a left and right direction of the guide surface 250*a*. The front side of the left portion 250*c* and the right portion 250*d* of the cover unit 250 and the rear side of the left portion 250*c* and the right portion 250*d* of the cover unit 250 are attached to the left surface 10*b* and the right surface 10*c* of the main body 10 by a fastening means 600 such as bolts and nuts, respectively.

As shown in FIGS. 1 and 2 and the like, the cover unit 250 has a plurality of first hook attachment units 210*a*, 210*b*, 210*c*, 210*d*, 210*e* from the front side to the rear side of the guide surface 250*a*. By providing a plurality of first hook attachment units 210*a* and the like, the attachment position of the first hook 200A can be selected and changed according to the usage environment, the preference of the worker, and the like. Meanwhile, in the present embodiment, the first hook attachment unit 210*a* and the like are provided on the guide surface 250*a* of the cover unit 250. However, the first hook attachment unit 210*a* and the like may be provided directly on the main body 10. Further, the first hook attachment unit 210*a* and the like are provided at five locations, but the number is not limited to five.

The first hook attachment unit 210*a* has an engaging hole 212*a* into which an engaging piece 202 of the first hook 200A is fitted, and screw holes 214*a*, 214*a* into which screws 206, 206 are screwed. The first hook attachment unit 210*d* has an engaging hole 212*d* into which the engaging piece 202 of the first hook 200A is fitted, and screw holes 214*d*, 214*d* into which the screws 206, 206 are screwed. Meanwhile, since the first hook attachment units 210*b*, 210*c*, 210*e* have the same configurations as the above-mentioned first hook attachment unit 210*a* and the like, detailed description thereof will be omitted.

As shown in FIGS. 1 to 5 and the like, the first hook 200A is a part for hooking the reinforcing bar binding machine 1A on the reinforcing bar S. In the present embodiment, the first hook 200A is formed of a flat plate member bent into a U-shape on the side surface. In the present embodiment, the first hook 200A has a bifurcated shape in which a slit is formed along the longitudinal direction thereof, but the first hook 200A is not limited to this shape. Meanwhile, the first hook 200A does not necessarily have to be U-shaped, and may be, for example, J-shaped, L-shaped, inverted C-shaped, or crank-shaped. That is, it is sufficient that the first hook 200A includes a hooking portion for hooking on the reinforcing bar, and a fixing portion for fixing to the cover unit 250 or the main body 10. Hereinafter, a case where the first hook 200A is attached to the first hook attachment unit 210*d* will be described.

As shown in FIG. 2 and the like, the engaging piece 202 and insertion holes 204, 204 are provided on the base end side of the first hook 200A (on the end portion on the side facing the first hook attachment unit 210*d*). The engaging piece 202 is formed to protrude from the base end portion of the first hook 200A toward the main body 10 and is configured to be engageable with the engaging hole 212*d* of the first hook attachment unit 210*d*. The insertion holes 204, 204 are formed at positions facing the screw holes 214*d*, 214*d* of the first hook attachment unit 210*d*.

In the present embodiment, the engaging piece 202 of the first hook 200A is fitted into the engaging hole 212*d* of the first hook attachment unit 210*d*, and the screws 206, 206 are screwed into the screw holes 214*d*, 214*d* of the first hook attachment unit 210*d* through the insertion holes 204, 204, so that the first hook 200A is fixed to the main body 10 (the cover unit 250). At this time, as shown in FIG. 3 and the like, the first hook 200A is fixed to the first hook attachment unit 210*d* so that the opening 201 into which the reinforcing bar S is inserted faces the front side in the front and rear direction.

As shown in FIGS. 1 to 3 and the like, the second hook attachment unit 310 is provided on an overhang portion 250*e* protruding downward from the left portion 250*c* of the cover unit 250. The second hook attachment unit 310 has an engaging hole 312 with which an engaging piece 302 of the second hook 300 is engaged, and screw holes 314, 314 into which the screws 306, 306 are screwed.

Meanwhile, in the present embodiment, the second hook attachment unit 310 is provided on the left surface 10*b* side of the main body 10. However, the second hook attachment unit 310 may be provided on the right surface 10*c* side of the main body 10 or may be provided on both the left surface 10*b* and the right surface 10*c* of the main body 10. Further, the second hook attachment unit 310 may be provided directly on the main body 10 instead of the cover unit 250.

The second hook 300 is a part for hooking the reinforcing bar binding machine 1A on the reinforcing bar S from the left surface 10*b* side. Similar to the first hook 200A, the second hook 300 is formed of a flat plate member bent into a U-shape on the side surface. In the present embodiment, the second hook 300 has a bifurcated shape in which a slit is formed along the longitudinal direction thereof, but the second hook 300 is not limited to this shape. Meanwhile, similar to the first hook 200A, the second hook 300 does not necessarily have to be U-shaped, and may be, for example, J-shaped, L-shaped, inverted C-shaped, or crank-shaped.

As shown in FIGS. 2 and 5 and the like, the engaging piece 302 and insertion holes 304, 304 are provided on the base end side of the second hook 300 (on the end portion on the side facing the second hook attachment unit 310). The engaging piece 302 is formed to protrude from the base end portion of the second hook 300 toward the main body 10 and is configured to be engageable with the engaging hole 312 of the second hook attachment unit 310. The insertion holes 304, 304 are formed at positions facing the screw holes 314, 314 of the second hook attachment unit 310.

In the present embodiment, the engaging piece 302 of the second hook 300 is fitted into the engaging hole 312 of the second hook attachment unit 310, and the screws 306, 306 are screwed into the screw holes 314, 314 of the second hook attachment unit 310 through the insertion hole 304, 304, so that the second hook 300 is fixed to the left surface 10*b* of the main body 10 (the cover unit 250).

In this case, when the main body 10 is viewed from the front (front view), as shown in FIGS. 3 and 5, the second hook 300 is attached to the second hook attachment unit 310 so that the second hook 300 does not block the opening 201 of the first hook 200A attached to the first hook attachment unit 210*d* and the like. Further, the second hook 300 is attached to the second hook attachment unit 310 so that the second hook 300 does not protrude from the guide surface 250*a* of the cover unit 250. Meanwhile, when the cover unit 250 is not provided, the second hook 300 is attached to the second hook attachment unit 310 so that the second hook 300 does not protrude from the upper surface 10*a* of the main body 10. Further, the second hook 300 may be attached to the second hook attachment unit 310 so that an opening 301 of the second hook 300 is located on the lower side or diagonally lower side in the upper and lower direction of the main body 10 and faces a center of gravity C of the reinforcing bar binding machine 1A.

Here, the center of gravity C of the reinforcing bar binding machine 1A is determined by the weights of the main body 10, the curl forming unit 5, the magazine 2, the gripping unit 11, and the battery 15 and the arrangement thereof. The magazine 2 which is heavier than other configurations (the curl forming unit 5, the gripping unit 11, and the like) by accommodating the wire W is provided in front of the lower surface 10*e* of the main body 10. Therefore, as shown in FIG. 3, the center of gravity C of the reinforcing bar binding machine 1A in the present embodiment is located in a space on the front side of the trigger 12 and in the vicinity of the magazine 2, in other words, in a space provided between the trigger 12 and the upper side of the magazine 2. Meanwhile, in the reinforcing bar binding machine 1A, the amount of the wire W is reduced by using the wire W accommodated in the magazine 2, and the total weight of the reinforcing bar binding machine 1A is also reduced accordingly. In this case, the center of gravity C of the reinforcing bar binding machine 1A is also slightly displaced, but the center of gravity C is not significantly changed.

As shown in FIG. 4 and the like, a wire feeding unit 3 includes a pair of feeding gears 30 that sandwich and feed one or a plurality of wires W arranged in parallel, and a feeding motor (not shown) that drives the feeding gears 30. In the wire feeding unit 3, the rotational operation of the feeding motor is transmitted via a transmission mechanism to rotate the feeding gears 30. The wire feeding unit 3 feeds the wire W sandwiched between the pair of feeding gears 30 along an extension direction of the wire W. In a configuration in which a plurality of wires W, for example, two wires W are fed, two wires W are fed in parallel.

The curl forming unit 5 includes a curl guide 50 for giving a curl to the wire W fed by the wire feeding unit 3, and a guiding guide 51 for guiding the wire W having the curl made by the curl guide 50 to the twisting unit 7. The curl guide 50 and the guiding guide 51 of the curl forming unit 5 are provided at an end portion on the front side of the main body 10. In the reinforcing bar binding machine 1A, the path of the wire W fed by the wire feeding unit 3 is regulated by the curl forming unit 5, so that the wire W is wound around the reinforcing bar S.

As shown in FIG. 4 and the like, a cutting unit 6 includes a fixed blade portion 60, a movable blade portion 61 for cutting the wire Win cooperation with the fixed blade portion 60, and a transmission mechanism 62 for transmitting the operation of the twisting unit 7 to the movable blade portion 61. The cutting unit 6 cuts the wire W by the rotational operation of the movable blade portion 61 with the fixed blade portion 60 as a fulcrum axis.

The twisting unit 7 includes a wire locking body 70 to which the wire W is locked, and a rotating shaft 72 for operating the wire locking body 70. The driving unit 8 includes a motor 80 and a reducer 81 that decelerates and amplifies a torque. In the twisting unit 7 and the driving unit 8, the rotating shaft 72 and the motor 80 are connected via the reducer 81, and the rotating shaft 72 is driven by the motor 80 via the reducer 81. The wire locking body 70 includes a sleeve 71 that operates a first side hook and a second side hook (which are not shown) in conjunction with the rotational operation of the rotating shaft 72.

The wire W fed by the wire feeding unit 3 is guided to the curl forming unit 5 through the wire locking body 70. Then, the wire W is curled by the curl forming unit 5, and a leading end side of the wire W guided to the twisting unit 7 is locked so as not to come off from the wire locking body 70. Subsequently, when the wire W is cut by the cutting unit 6, the sleeve 71 moves in the forward direction to bend the tip side of the wire W locked by the wire locking body 70 and the terminal side of the wire W cut by the cutting unit 6 toward the reinforcing bar S.

When the sleeve 71 further moves in the forward direction after the tip side and the terminal side of the wire W are bent toward the reinforcing bar S, the sleeve 71 rotates in conjunction with the rotating shaft 72, and the wire W locked by the wire locking body 70 is twisted.

Usage Example of First Hook 200A

Figure 6A:
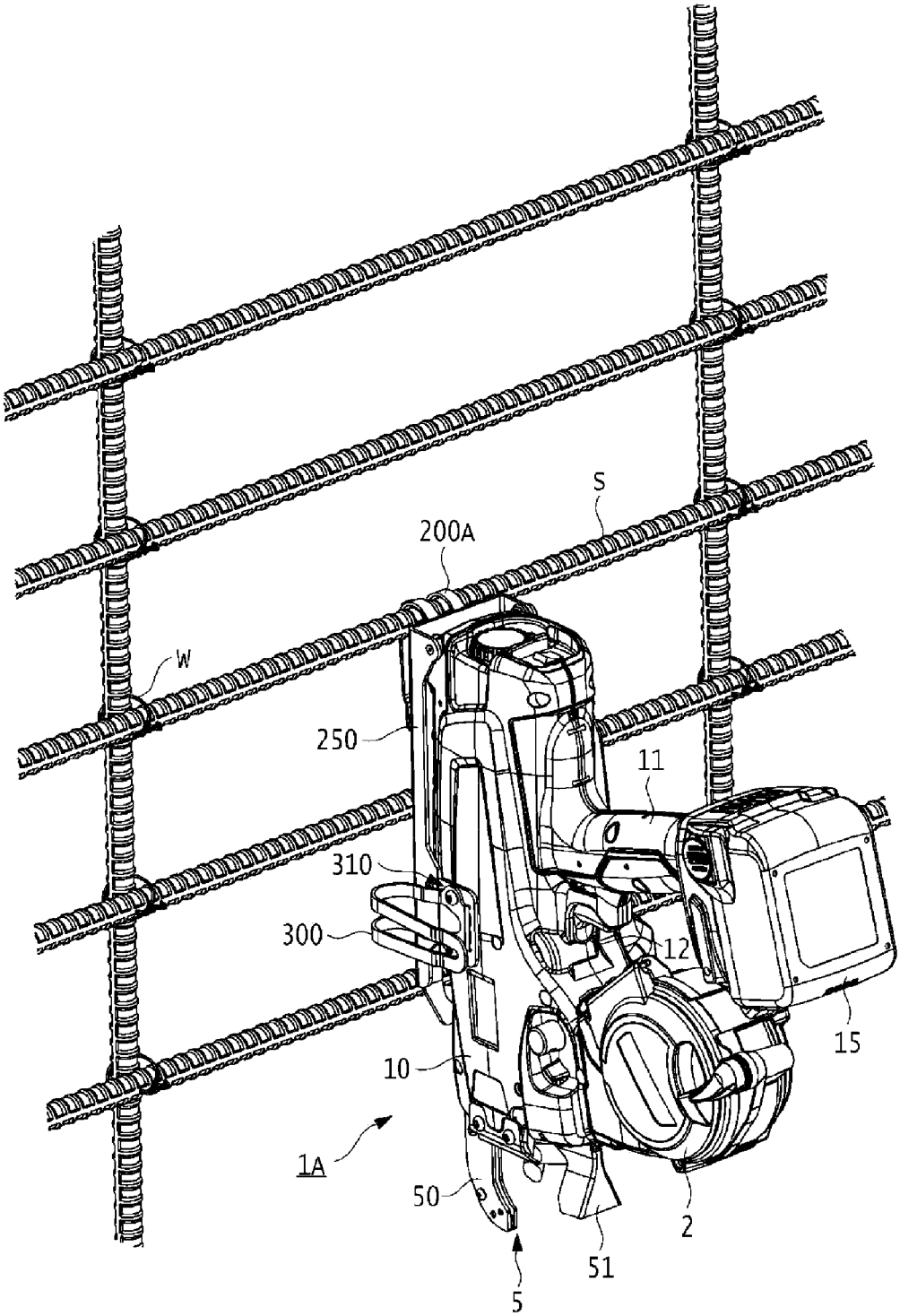
FIG. 6A is a view in which a first hook of the reinforcing bar binding machine according to the first embodiment is used.

FIG. 6A shows an example in which the first hook 200A is used. For example, when the binding work (the binding of the reinforcing bar S by the wire W) is finished, the worker removes the curl forming unit 5 on the front end side of the main body 10 from the reinforcing bar S. Thereafter, the worker tilts the curl forming unit 5 downward and moves the reinforcing bar binding machine 1A downward while causing the upper surface 10*a* side of the main body 10 to face the reinforcing bar surface (that is, the reinforcing bar S) and causing the guide surface 250*a* of the cover unit 250 to be placed along the reinforcing bar surface or causing the guide surface 250*a* to be in contact with the reinforcing bar S (causing the reinforcing bar S to slide on the guide surface 250*a*). In this way, the worker can hook the reinforcing bar S on the first hook 200A. Therefore, when hooking the first hook 200A on the reinforcing bar S, the worker only needs to tilt and move the reinforcing bar binding machine 1A downward, and does not need to turn over his wrist to rotate the reinforcing bar binding machine 1A. Therefore, the work efficiency can be improved and the work load on the worker can be reduced.

Usage Example of Second Hook 300

Figure 6B:
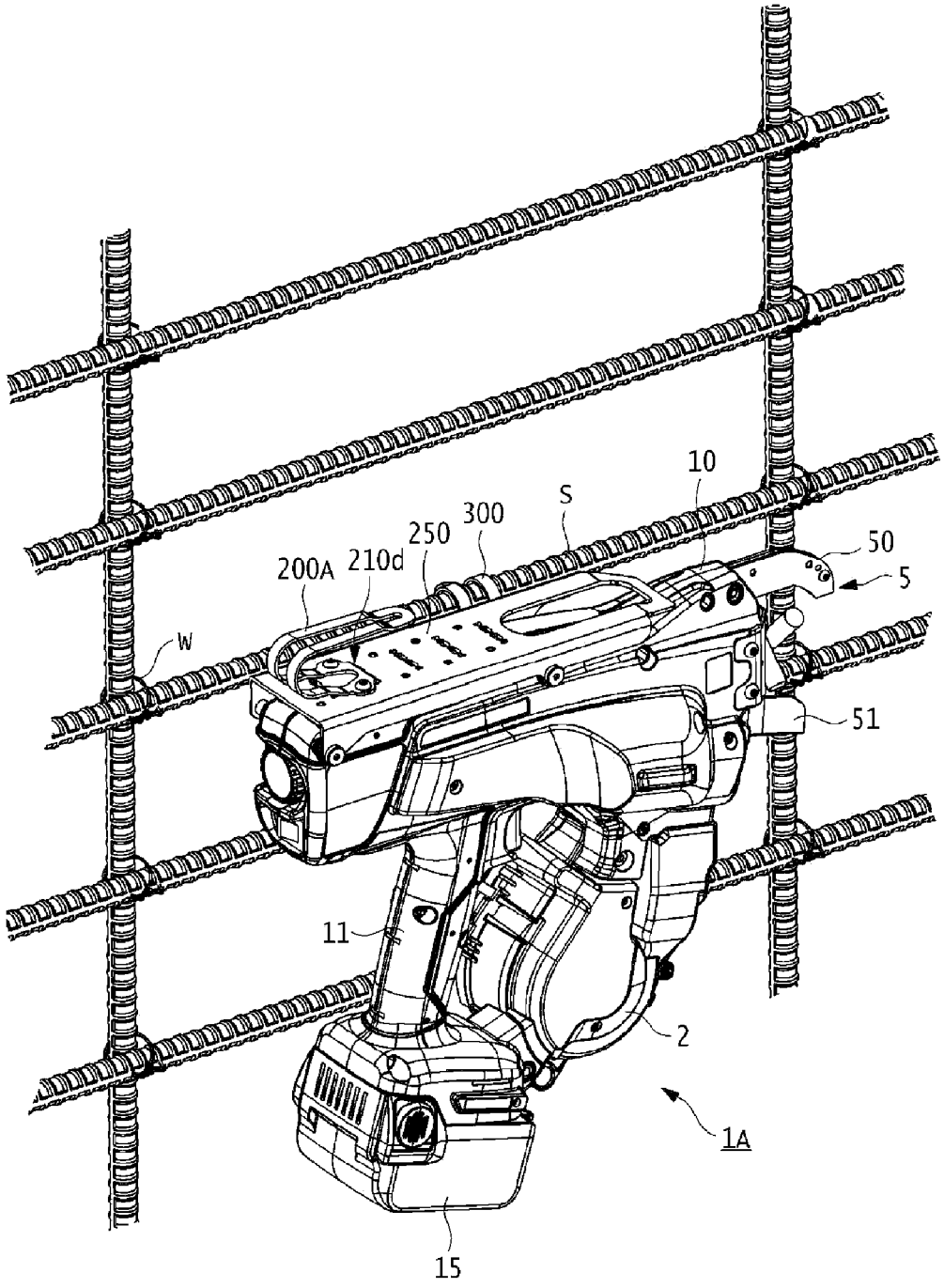
FIG. 6B is a view in which a second hook of the reinforcing bar binding machine according to the first embodiment is used.

FIG. 6B shows an example in which the second hook 300 is used. For example, when the binding work is finished, the worker rotates the reinforcing bar binding machine 1A so that the left surface 10*b* of the main body 10 is substantially parallel to the reinforcing bar surface, and hooks the second hook 300 on the reinforcing bar S. When the reinforcing bar S is hooked on the second hook 300 in this way, the reinforcing bar binding machine 1A is held so that the main body 10 is substantially parallel to the reinforcing bar surface. Therefore, the amount of protrusion of the main body 10 with respect to the reinforcing bar S can be reduced, and even when the reinforcing bar binding machine 1A is hooked on the reinforcing bar S, the reinforcing bar binding machine 1A does not interfere with the work, and smooth movement and work can be performed at the work site.

Modified Example of Second Hook Attachment Unit 310

Meanwhile, the second hook attachment unit 310 can be attached on the left surface 10*b* side and the right surface 10*c* side of the main body 10 and is not limited to the attachment position shown in FIG. 1 and the like, as long as the second hook 300 can be attached so that the opening 301 of the second hook 300 faces the center of gravity C of the reinforcing bar binding machine 1A.

Figure 7:
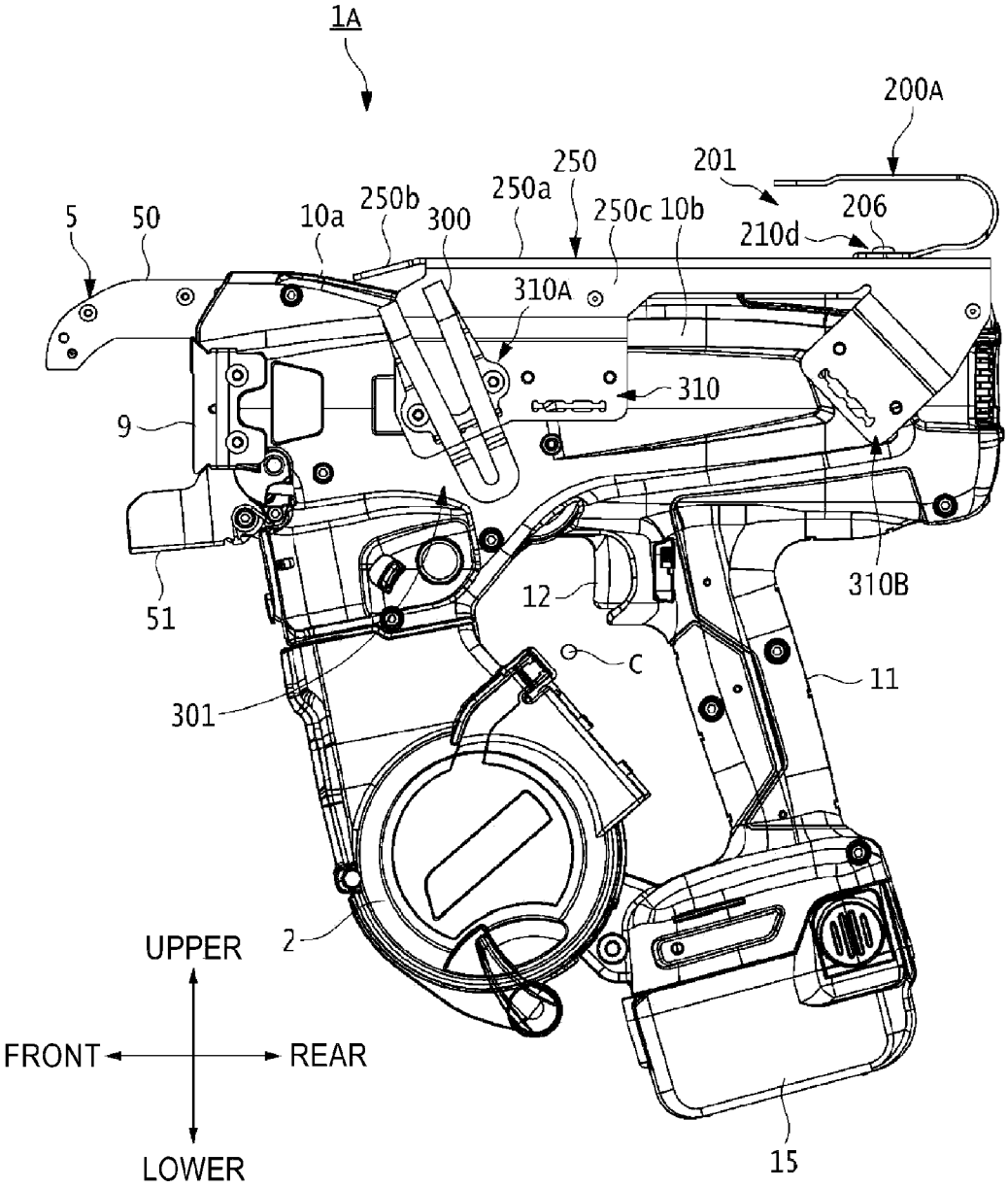
FIG. 7 is a modified example of a second hook attachment unit of the reinforcing bar binding machine according to the first embodiment.

FIG. 7 is a view showing a modified example of the second hook attachment unit 310. The reinforcing bar binding machine 1A includes second hook attachment units 310A, 310B, in addition to the above-mentioned second hook attachment unit 310.

As shown in FIG. 7, the second hook attachment unit 310A is provided on the front portion side of the left surface 10*b* of the main body 10 and is tilted so that the opening 301 of the second hook 300 faces the center of gravity C of the reinforcing bar binding machine 1A. In this case, the second hook 300 is attached to the second hook attachment unit 310A so that the second hook 300 does not protrude from the upper surface 10*a* of the main body 10 or the guide surface 250*a* of the cover unit 250, and the second hook 300 does not block the opening 201 of the first hook 200A. Further, the second hook 300 can also be attached to the second hook attachment unit 310B by the same attachment method as that of the second hook attachment unit 310A.

According to the first embodiment, the first hook 200A is attached to the first hook attachment unit 210*a* and the like so that the first hook 200A is located on the upper surface 10*a* side of the main body 10, and the opening 201 of the first hook 200A faces the front side. Therefore, when the first hook 200A is attached to the first hook attachment unit 210*a* and the like, after the binding work to the reinforcing bar S or the like located in front of the worker, the worker can hook the reinforcing bar binding machine 1A on the reinforcing bar S or the like with a small number of movements while tilting the front end side of the main body 10 having the curl forming unit 5 and the twisting unit 7 downward and without turning over his wrist. Therefore, when the reinforcing bar binding machine 1A is repeatedly used and hooked when not in use, the work efficiency can be improved and the work load on the worker can be reduced.

Further, since the reinforcing bar binding machine 1A is configured so that the magazine 2 for accommodating the wire W and the gripping unit 11 are provided on the lower surface 10*e* side of the main body 10, the center of gravity C of the reinforcing bar binding machine 1A is located below the main body 10, more specifically, near the magazine 2. Therefore, when such a reinforcing bar binding machine 1A is hooked on the reinforcing bar S or the like via the first hook 200A attached to the first hook attachment unit 210*a* and the like, due to the relationship with the position of the center of gravity, the reinforcing bar binding machine 1A does not become significantly tilted (moved) and unstable, and can be stably held. That is, since the reinforcing bar binding machine 1A is stably hooked on the reinforcing bar S or the like, problems such as the reinforcing bar binding machine 1A falling from the reinforcing bar are less likely to occur.

Further, the second hook 300 is attached to the second hook attachment unit 310 so that the second hook 300 is provided on the left surface 10*b* side of the main body 10, and the opening 301 of the second hook 300 faces downward. Therefore, when the reinforcing bar binding machine 1A is hooked on the reinforcing bar S or the like, the reinforcing bar binding machine 1A is held so that the left surface 10*b* in the front and rear direction of the main body 10 is substantially parallel to the reinforcing bar S or the like. Therefore, the amount of protrusion of the main body 10 with respect to the reinforcing bar S or the like can be reduced, and even when the reinforcing bar binding machine 1A is hooked on the reinforcing bar S, the reinforcing bar binding machine 1A does not interfere with the work, and smooth movement and work can be performed at the work site.

And, according to the first embodiment, the first hook attachment unit 210*a* and the like and the second hook attachment unit 310 having the above-mentioned effects are provided in one reinforcing bar binding machine 1A. Therefore, the work efficiency can be improved and the work load on the worker can be reduced in various situations at various work sites.

Further, according to the first embodiment, the second hook 300 is attached to the second hook attachment unit 310 so that the second hook 300 does not block the opening 201 of the first hook 200A, and the second hook 300 is attached to the second hook attachment unit 310 so that the second hook 300 does not protrude from the upper surface 10*a* of the main body 10 or the guide surface 250*a* of the cover unit 250. Therefore, it is possible to prevent the second hook 300 from becoming an obstacle when the first hook 200A is hooked on the reinforcing bar S.

Further, according to the first embodiment, since the cover unit 250 and the guide surface 250*a* are provided, the reinforcing bar S can be guided while sliding in the opening 201 of the first hook 200A, and therefore, the first hook 200A can be easily hooked on the reinforcing bar S. Further, since the cover unit 250 is provided, it is possible to prevent the reinforcing bar S from coming into direct contact with the main body 10, thereby preventing the damage of the main body 10.

Second Embodiment

A reinforcing bar binding machine 1B according to a second embodiment is different from the reinforcing bar binding machine 1A of the first embodiment in that a hook 200B can be moved and retracted to the rear side of the main body 10. Meanwhile, the components having substantially the same function as the reinforcing bar binding machine 1A according to the above-mentioned embodiment are designated by the same reference numerals, and duplicate description will be omitted.

Configuration Example of Reinforcing Bar Binding Machine 1B

Figure 8A:
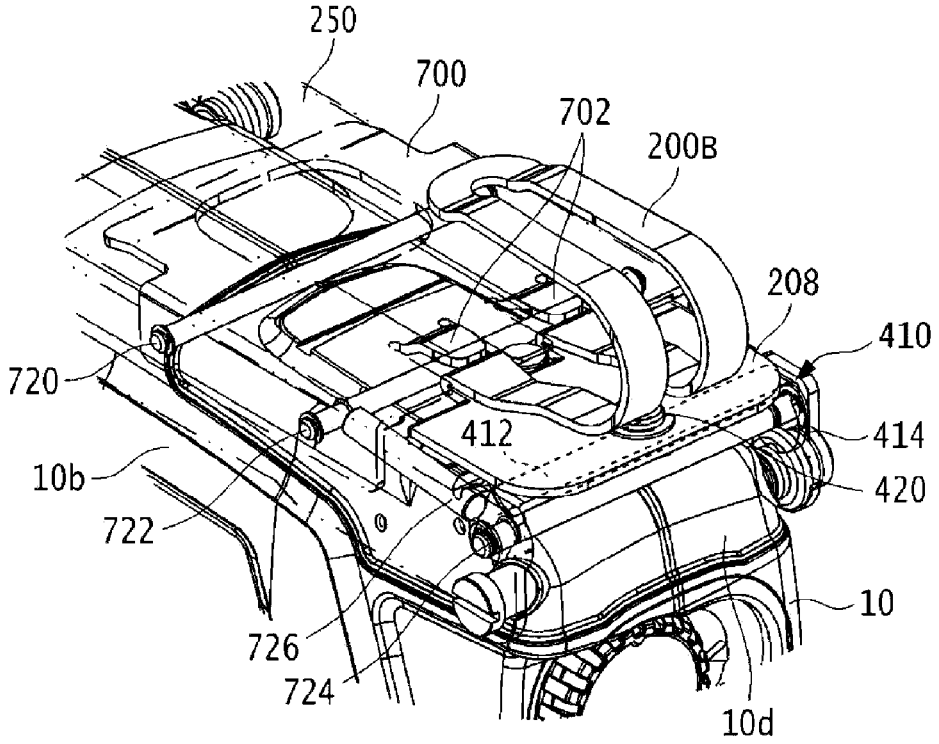
FIG. 8A is a perspective view showing a hook and a hook attachment unit of a reinforcing bar binding machine according to a second embodiment.
Figure 8B:
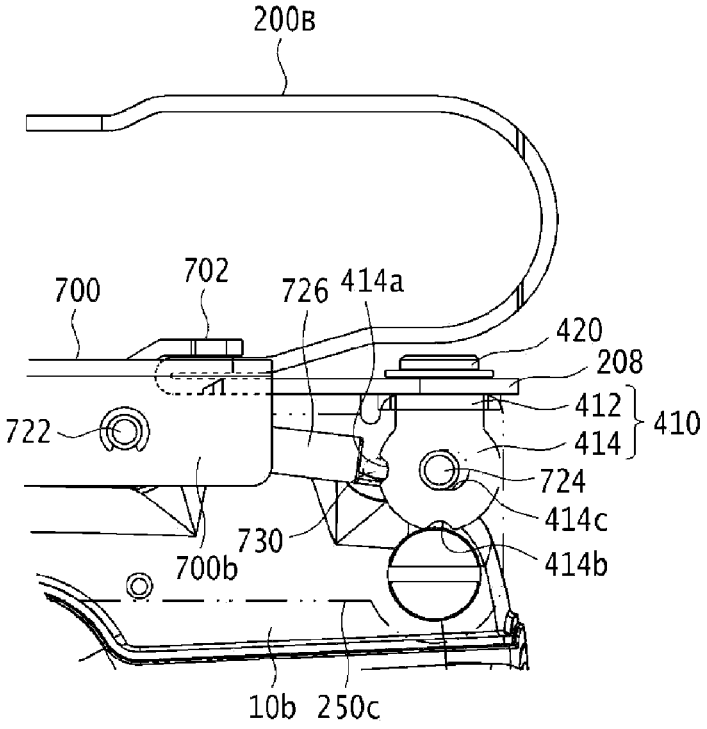
FIG. 8B is a side view showing the hook and the hook attachment unit of the reinforcing bar binding machine according to the second embodiment.

FIG. 8A is a perspective view showing the hook 200B and a hook attachment unit 410 of the reinforcing bar binding machine 1B, and FIG. 8B is a side view of the hook 200B and the hook attachment unit 410.

As shown in FIGS. 8A and 8B, the reinforcing bar binding machine 1B includes a lock plate 700 for locking the hook 200B at a usage position P1, and the hook attachment unit 410 for supporting the hook 200B to be movable from the usage position P1 on the upper surface 10*a* side of the main body 10 to a retreat position P2 on a rear surface 10*d* side. Here, the usage position P1 refers to a position where the hook 200B is located on the upper surface 10*a* side of the main body 10, and the hook 200B can be hooked on the reinforcing bar S. The retreat position P2 refers to a position where the hook 200B is located on the rear surface 10*d* side of the main body 10, and the hook 200B does not become an obstacle or interference during work or transportation.

As shown in FIG. 8A, the lock plate 700 is a flat plate member having a substantially inverted C-shaped cross section and covers the rear side of the upper surface 10*a* of the cover unit 250. Retaining portions 702, 702 for locking the hook 200B at the usage position P1 are provided on the rear end side of the lock plate 700. As shown in FIG. 8B, the retaining portions 702, 702 are provided to protrude (float) upward with respect to the flat surface of the lock plate 700 by at least the thickness of the hook 200B so that the hook 200B can be inserted below the retaining portions 702, 702. Meanwhile, in the present embodiment, the retaining portions 702, 702 are provided at two locations according to the bifurcated shape of the hook 200B. However, the disclosure is not limited to this, and the retaining portions 702, 702 can be appropriately changed according to the shape of the hook 200B.

The lock plate 700 has a left portion 700*a* and a right portion 700*b* erected downward from both end portions in the left and right direction. As shown in FIG. 8A, a first shaft 720 and a second shaft 722 extending in the left and right direction are respectively inserted through the left portion 700*a* and the right portion 700*b* of the lock plate 700, and the left portion 250*c* and the right portion 250*d* of the cover unit 250 arranged inside the lock plate 700. Openings for supporting the first shaft 720 and the second shaft 722 of the cover unit 250 are elongated holes (not shown), so that the lock plate 700 is configured to be movable in the front and rear direction with respect to the cover unit 250.

As shown in FIGS. 8A and 8B, the hook attachment unit 410 has a flat plate member 412 extending in the left and right direction of the main body 10, and lock portions 414, 414 erected downward from both end portions of the flat plate member 412. Meanwhile, since the lock portion 414 has a common configuration on the left and right, only one of them will be described below for convenience.

A folded-back portion 208 of the hook 200B is attached to a central portion of an upper surface of the flat plate member 412 by a stopper 420. The folded-back portion 208 is a portion that folds back and extends from a base end portion of the hook 200B toward a curved portion on the opposite side. The hook 200B is configured to be pivotable around the axis of the stopper 420, so that the orientation of the hook 200B can be changed.

As shown in FIG. 8B, the lock portion 414 has a substantially circular shape in a plan view, and is arranged inside the left portion 250*c* of the cover unit 250. A third shaft 724 is inserted through the lock portion 414 and the left portion 250*c* of the cover unit 250. An opening 414*c* for supporting the third shaft 724 of the lock portion 414 is an elongated hole, so that the third shaft 724 is configured to be movable in the front and rear direction with respect to the lock portion 414.

As shown in FIG. 8A, a tension spring 726 is provided between the second shaft 722 and the third shaft 724. One end of the tension spring 726 is attached to the second shaft 722, and the other end is attached to the third shaft 724. In this way, each of the second shaft 722 and the third shaft 724 is urged in a direction facing each other by an elastic force of the tension spring 726.

As shown in FIG. 8B, a dowel 730 protruding inward is provided on an inner surface of the left portion 250*c* of the cover unit 250. A first recessed portion 414*a* and a second recessed portion 414*b* are formed at a predetermined interval on a peripheral edge of the lock portion 414. When the hook 200B is located at the usage position P1, the first recessed portion 414*a* engages with the dowel 730 to lock the hook 200B at the usage position P1. When the hook 200B is located at the retreat position P2, the second recessed portion 414*b* engages with the dowel 730 to lock the hook 200B at the retreat position P2.

Operation Example of Reinforcing Bar Binding Machine 1B

Figure 9A:
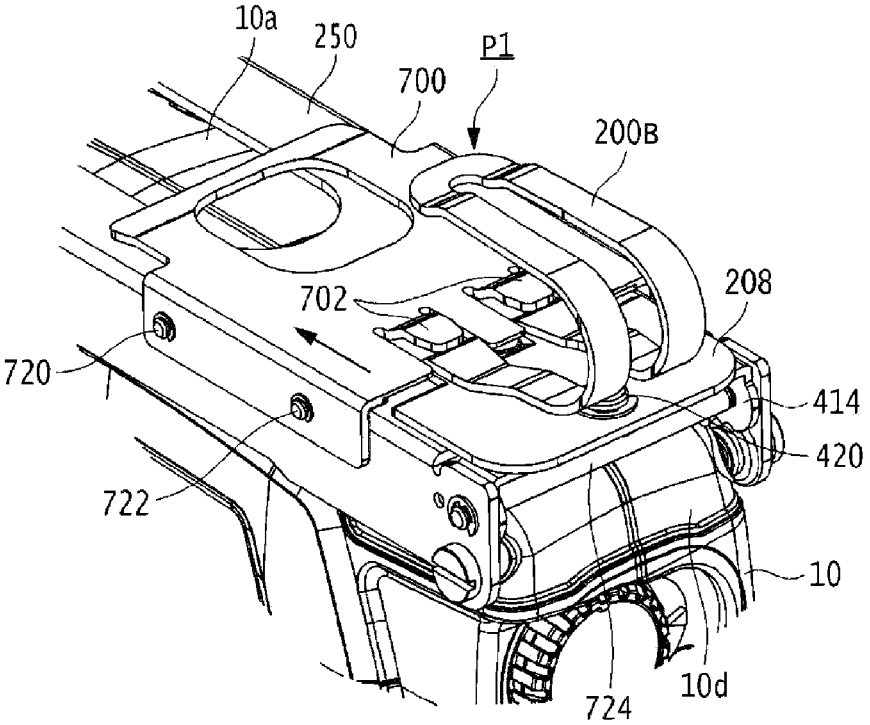
FIG. 9A is a perspective view showing an operation when the hook in the reinforcing bar binding machine according to the second embodiment is moved from a usage position to a retreat position.
Figure 9B:
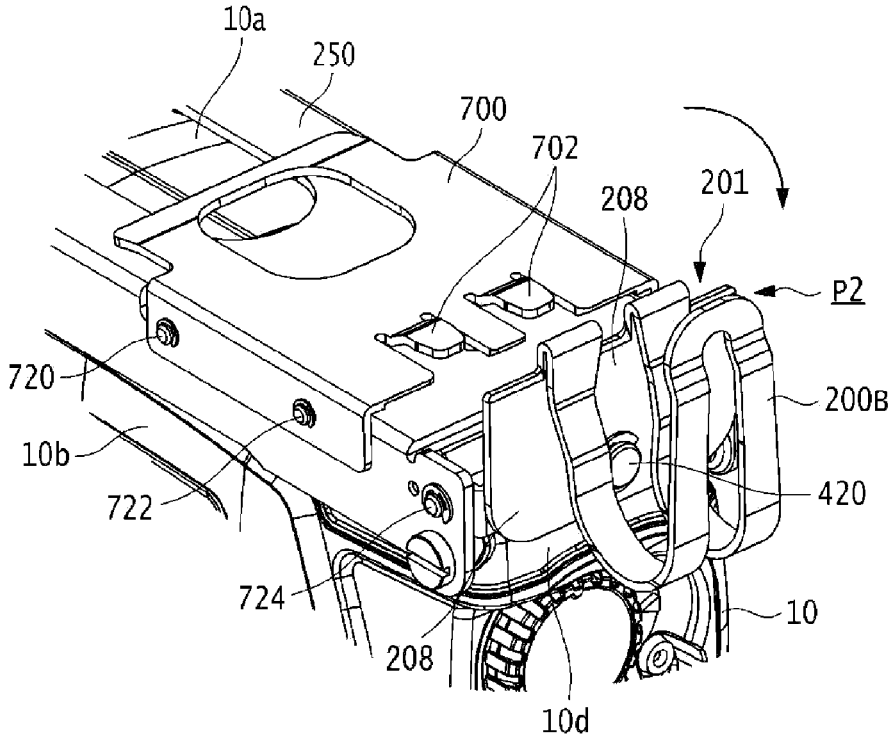
FIG. 9B is a perspective view showing an operation when the hook in the reinforcing bar binding machine according to the second embodiment is moved from the usage position to the retreat position.
Figure 9C:
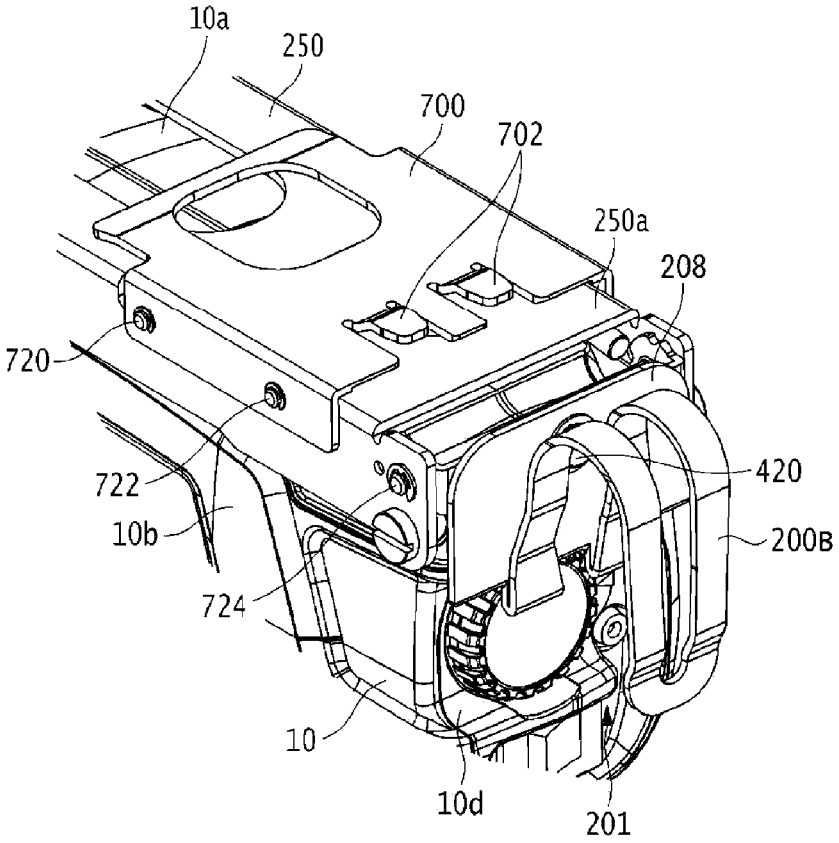
FIG. 9C is a perspective view showing an operation when the hook in the reinforcing bar binding machine according to the second embodiment is moved from the usage position to the retreat position.

Next, an operation at the time of moving the hook 200B from the usage position P1 on the upper surface 10*a* side of the main body 10 to the retreat position P2 on the rear surface 10*d* side of the main body 10 will be described. FIGS. 9A to 9C are operation views of the reinforcing bar binding machine 1B at the time of moving the hook 200B from the usage position P1 to the retreat position P2.

As shown in FIG. 9A, the worker slides the lock plate 700 gripped by one hand forward with respect to the cover unit 250. Along with this, the retaining portions 702, 702 are moved forward and displaced from the base end portion of the hook 200B, whereby the lock of the hook 200B is released.

Subsequently, the worker grips the hook 200B with the other hand and rotates the hook 200B backward, as shown in FIG. 9B. In this way, the lock portion 414 moves backward with respect to the third shaft 724 by the opening 414*c*, so that the first recessed portion 414*a* of the lock portion 414 is disengaged from the dowel 730, and the engagement state between the first recessed portion 414*a* and the dowel 730 is released.

Subsequently, when the hook 200B pivots from the usage position P1 to the retreat position P2 with the third shaft 724 as a fulcrum, since the lock portion 414 is urged forward by the tension spring 726, the second recessed portion 414*b* of the lock portion 414 engages with the dowel 730. In this way, the hook 200B is held at the retreat position P2.

Subsequently, as shown in FIG. 9C, the worker rotates the hook 200B by 180° with the axis of the stopper 420 as a fulcrum so that the opening 201 of the hook 200B faces from the upper side to the lower side, thereby turning the hook 200B upside down. Sine the hook 200B is urged forward by the tension spring 726 and the folded-back portion 208 of the hook 200B comes into contact with the rear surface 10*d* of the main body 10, the hook 200B does not rotate due to the frictional force. With such a series of operations, the hook 200B can be moved from the usage position P1 to the retreat position P2. Meanwhile, the hook 200B can be moved from the retreat position P2 to the usage position P1 by executing the operations opposite to the series of operations described above.

As described above, according to the second embodiment, for example, in a case where the hook 200B on the upper surface 10*a* of the main body 10 becomes an obstacle during the binding work, the hook 200B can be retracted from the upper surface 10*a* of the main body 10 to the rear surface 10*d* side and the like. In this way, the work efficiency can be improved. Meanwhile, although, in the second embodiment, the first hook attachment unit 210 has been moved to the rear surface 10*d* side, the first hook attachment unit 210 may be configured to be movable to the left surface 10*b* side or the right surface 10*c* side. When the hook 200B is moved from the upper surface 10*a* side of the main body 10 to the left surface 10*b* side, the hook 200B can be used as a hook to be hooked on the reinforcing bar S or the like. Naturally, the hook attachment unit provided on the left surface 10*b* side or the right surface 10*c* side of the main body 10 may be configured to be movable to the upper surface 10*a* side of the main body 10. In this way, since one hook 200B can be used properly according to the situations of various work sites, the cost reduction can be achieved compared with the case of using two hooks.

Third Embodiment

A reinforcing bar binding machine 1C of a third embodiment is different from the reinforcing bar binding machine 1A of the first embodiment in that a hook 200C can be retracted to a side surface side of the main body 10 when the hook 200C is not used. Meanwhile, the components having substantially the same function as the reinforcing bar binding machine 1A according to the above-mentioned embodiment are designated by the same reference numerals, and duplicate description will be omitted.

Configuration Example of Reinforcing Bar Binding Machine 1C

Figure 10:
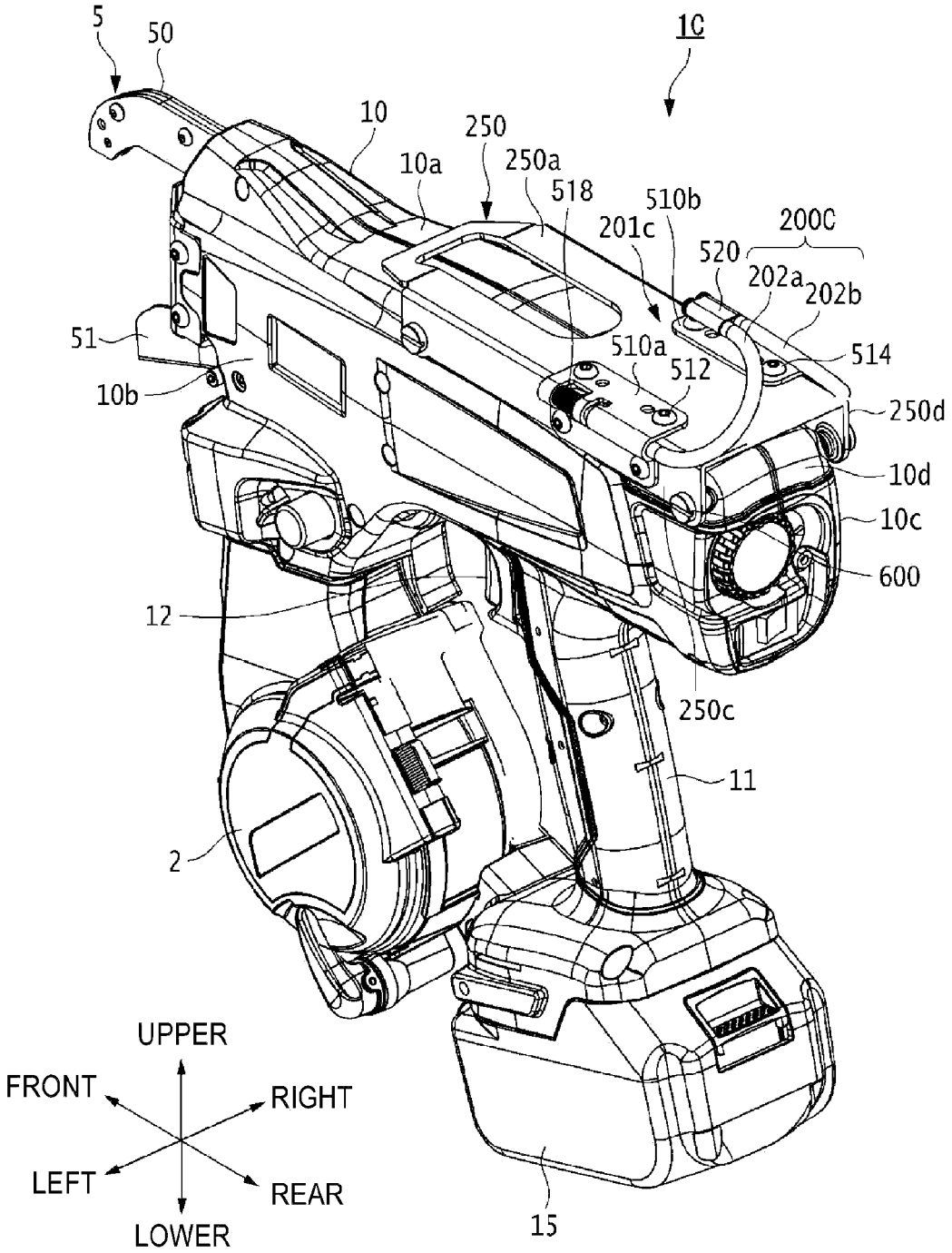
FIG. 10 is a perspective view of a reinforcing bar binding machine according to a third embodiment as viewed from the rear side of the left surface.
Figure 11A:
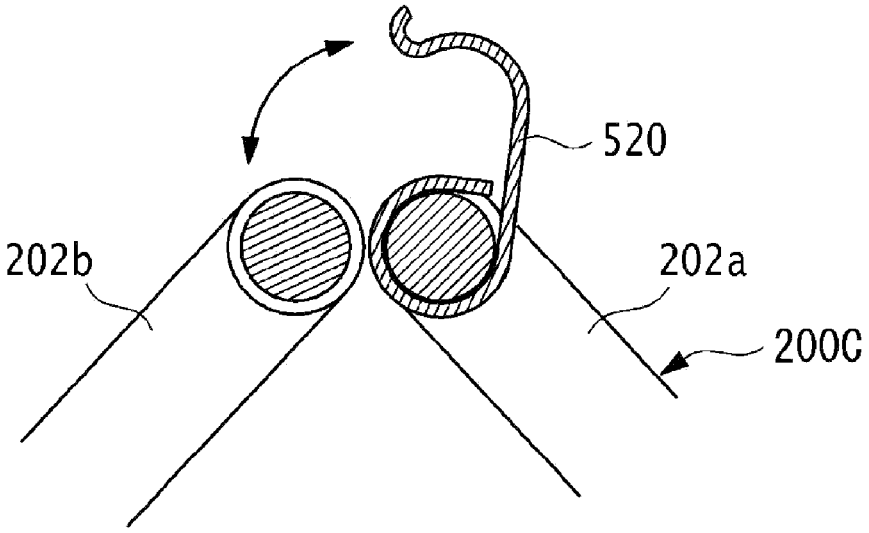
FIG. 11A is a sectional view showing a stopper for engaging a hook according to the third embodiment.
Figure 11B:
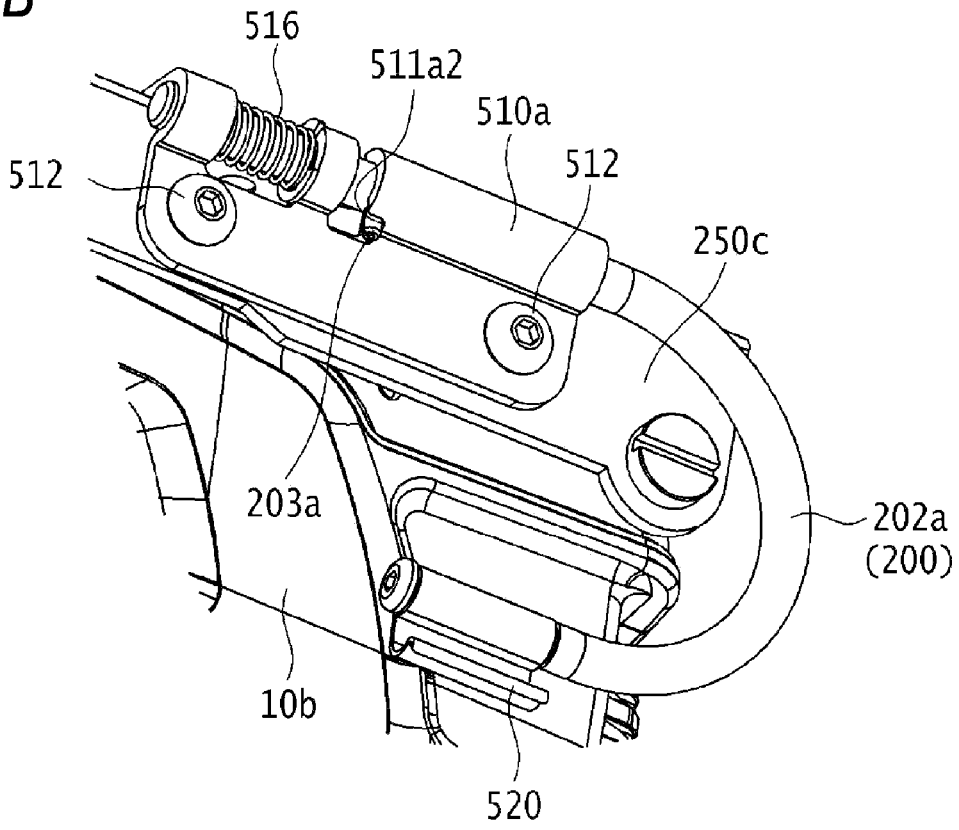
FIG. 11B is a perspective view showing a state in which the hook attached to a hook attachment unit according to the third embodiment is locked at the retreat position.

FIG. 10 is a perspective view of the reinforcing bar binding machine 1C according to the third embodiment as viewed from the rear side of the left surface. FIG. 11A is a sectional view showing a stopper 520 for engaging the hook 200C, and FIG. 11B is a perspective view showing a state in which the hook 200C attached to the hook attachment unit 510*a* is locked at the retreat position P2.

The reinforcing bar binding machine 1C includes hook attachment units 510*a*, 510*b* for supporting the hook 200C to be movable from the usage position P1 (see FIG. 10) on the upper surface 10*a* side of the main body 10 to the retreat position P2 (see FIG. 12) on the left surface 10*b* side and the right surface 10*c* side. The hook 200C according to the third embodiment has a pair of hook members 202*a*, 202*b* having a substantially U-shape (J-shape). Meanwhile, the first hook 200C does not necessarily have to be U-shaped, and may be, for example, J-shaped, L-shaped, inverted C-shaped, or crank-shaped.

The hook member 202*a* is attached to the hook attachment unit 510*a* so that the hook member 202*a* can be pivoted from the upper surface 10*a* side of the main body 10 to the left surface 10*b* side. The hook attachment unit 510*a* is configured by, for example, a flat hinge, and is fastened to the guide surface 250*a* and the left portion 250*c* of the cover unit 250 by screws 512 with a base end side of the hook member 202*a* inserted in its pipe.

The hook member 202*b* is attached to the hook attachment unit 510*b* so that the hook member 202*b* can be pivoted from the upper surface 10*a* side of the main body 10 to the right surface 10*c* side. The hook attachment unit 510*b* is configured by, for example, a flat hinge, and is fastened to the guide surface 250*a* and the right portion 250*d* of the cover unit 250 by screws 514 with a base end side of the hook member 202*b* inserted in its pipe.

The hook 200C is attached to the hook attachment units 510*a*, 510*b* so that an opening 201*c* of the hook 200C including the hook members 202*a*, 202*b*, into which the reinforcing bar S is inserted, faces the front side in the front and rear direction of the main body 10.

As shown in FIGS. 10 and 11A, the stopper 520 having a hook portion on the tip side is pivotably attached to a tip end portion of the hook member 202*b* constituting the hook 200C. The stopper 520 couples (integrates) the tip ends of the hook members 202*a*, 202*b* by fitting the other hook member 202*a* to the hook portion in a state where the tip ends of the hook members 202*a*, 202*b* are butted above the main body 10.

Figure 12:
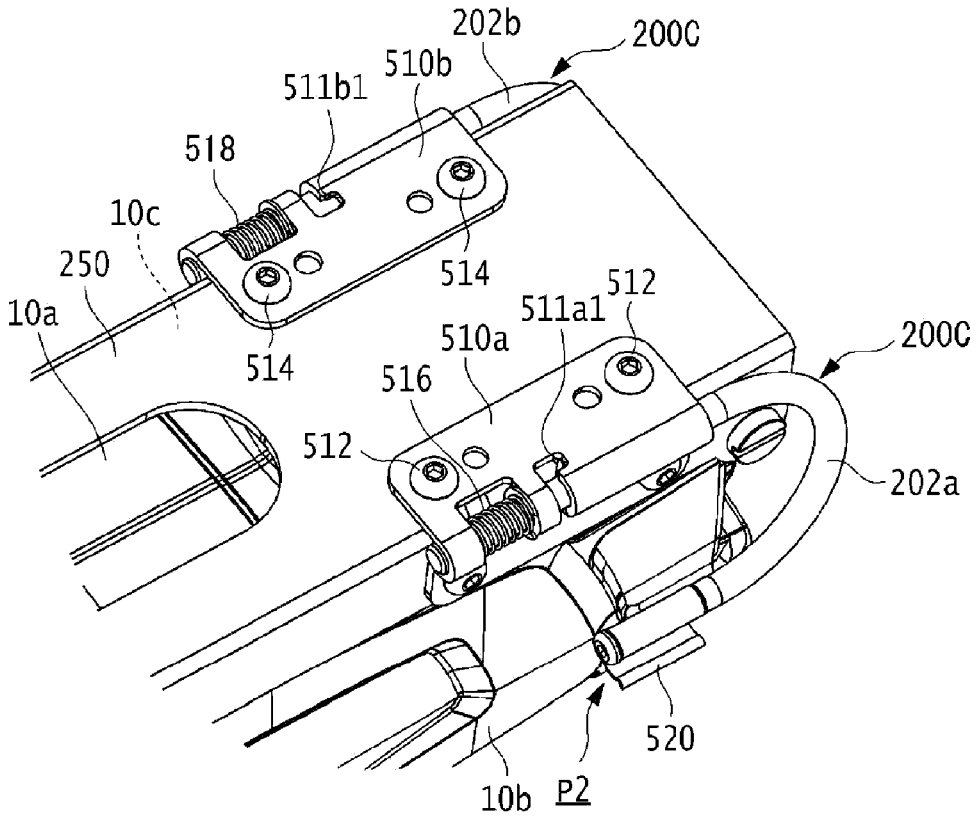
FIG. 12 is a perspective view showing an operation when the hook in the reinforcing bar binding machine according to the third embodiment is moved from a usage position to a retreat position.

The hook 200C is urged to the rear of the main body 10 by springs 516, 518. As shown in FIGS. 11B and 12 described later, a pin 203*a* is inserted into the hook member 202*a* of the hook 200C and protrudes therefrom. The hook attachment unit 510*a* is provided with grooves 511*a*1, 511*a*2 at two locations corresponding to the usage position P1 and the retreat position P2. Similarly, although some illustrations are omitted, a pin 203*b* is also inserted into the hook member 202*b* and protrudes therefrom, and the hook attachment unit 510*b* is provided with grooves 511*b*1, 511*b*2 at two locations. The pins 203*a*, 203*b* inserted into the hook 200C urged by the springs 516, 518 respectively enter the grooves 511*a*1, 511*b*1 at the usage position P1 and respectively enter the grooves 511*a*2, 511*b*2 at the retreat position P2, thereby regulating the rotation of the hook 200C.

Operation Example of Reinforcing Bar Binding Machine 1C

FIG. 12 is an operation view of the reinforcing bar binding machine 1C at the time of moving the hook 200C from the usage position P1 to the retreat position P2.

As shown in FIG. 11A and the like, in the hook 200C at the usage position P1, the hook portion of the stopper 520 is pivoted in a direction away from the hook member 202*a*, whereby the stopper 520 is removed from the hook member 202*a* and the hook members 202*a*, 202*b* are separated.

Subsequently, as shown in FIG. 12, the hook member 202*a* is accommodated on the left surface 10*b* side of the main body 10 by pushing the hook member 202*a* forward to release the fitting between the pin 203*a* and the groove 511*a*1 on one side and pivoting the hook member 202*a* from the usage position P1 on the upper surface 10*a* side of the main body 10 to the retreat position P2 on the left surface 10*b* side of the main body 10. Since the hook member 202*a* is urged by the spring 516, the pin 203*a* enters the groove 511*a*2 on the other side (see FIG. 11B) and does not rotate from the accommodation position. Similarly, the hook member 202*b* is accommodated on the right surface 10*c* side of the main body 10 by pushing the hook member 202*b* forward to release the fitting between the pin 203*b* and the groove 511*b*1 on one side and pivoting the hook member 202*b* from the usage position P1 on the upper surface 10*a* side of the main body 10 to the retreat position P2 on the right surface 10*c* side. Since the hook member 202*b* is urged by the spring 518, the pin 203*b* enters the groove 511*b*2 on the other side and does not rotate from the accommodation position.

As described above, according to the third embodiment, for example, when the hook 200C on the upper surface 10*a* of the main body 10 becomes an obstacle during the binding work, the hook 200C can be retracted from the upper surface 10*a* of the main body 10 to the left surface 10*b* and the like. In this way, the work efficiency can be improved.

Fourth Embodiment

In a reinforcing bar binding machine 1D according to a fourth embodiment, the hook attachment unit 210*a* and the like are provided only on the upper surface 10*a* side of the main body 10. Meanwhile, the components having substantially the same function as the reinforcing bar binding machine 1A according to the above-mentioned embodiment are designated by the same reference numerals, and duplicate description will be omitted.

Figure 13:
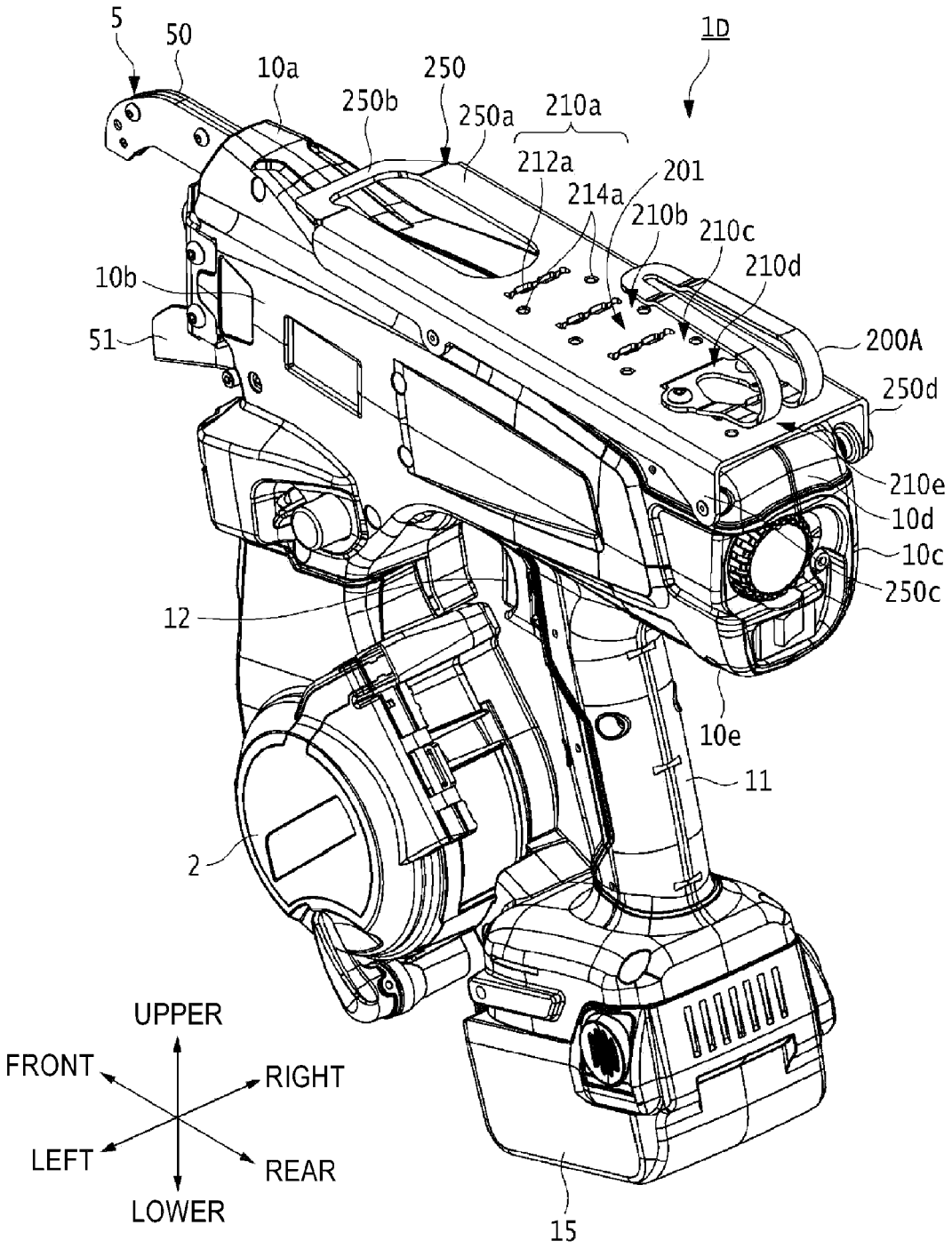
FIG. 13 is a perspective view of a reinforcing bar binding machine according to a fourth embodiment as viewed from the rear side of the left surface.

FIG. 13 is a perspective view of the reinforcing bar binding machine 1D according to the fourth embodiment as viewed from the rear side of the left surface.

As shown in FIG. 13, the reinforcing bar binding machine 1D includes the main body 10, the binding unit 4 having the curl forming unit 5 and the twisting unit 7 is provided on the front end side in the longitudinal direction of the main body 10, and the driving unit 8 for driving the binding unit 4 is accommodated inside the main body 10 (see FIG. 4). The reinforcing bar binding machine 1D includes the magazine 2 provided on the lower surface 10*e* side of the main body 10 and configured to accommodate the wire W so that the wire W can be sent out, the gripping unit 11 located on the lower surface 10*e* side of the main body 10 and on the rear side of the magazine 2, and a plurality of hook attachment units 210*a* to 210*e* located on the upper surface 10*a* side of the main body 10 and on which the U-shaped hook 200A opened at one side can be installed. Although, in the present embodiment, the hook 200A is configured to have a U-shape on the side surface, the hook 200A does not necessarily have to be U-shaped, and may be, for example, J-shaped, L-shaped, inverted C-shaped, or crank-shaped.

The hook attachment unit 210*d* and the like are provided along the front and rear direction (longitudinal direction) of the guide surface 250*a* of the cover unit 250. The hook 200A is attached to the hook attachment unit 210*d* and the like so that the opening 201 of the hook 200A faces the front side in the front and rear direction of the main body 10. Meanwhile, as described in the first embodiment, the number of the hook attachment unit 210*d* and the like is not limited to five, and any number can be provided. Further, the hook attachment unit 210*d* and the like may be provided directly on the upper surface 10*a* of the main body 10.

As shown in FIG. 8A and the like, the hook 200A may be attached to the hook attachment unit 210*d* and the like so that the hook 200A is movable from the upper surface 10*a* side of the main body 10 to the rear surface 10*d* side. Further, as shown in FIG. 10 and the like, the hook 200A may be attached to the hook attachment unit 210*d* and the like so that the hook 200A is movable from the upper surface 10*a* side of the main body 10 to at least one surface side of the left surface 10*b* side and the right surface 10*c* side.

As described above, since the reinforcing bar binding machine 1D of the fourth embodiment is configured so that the magazine 2 for accommodating the wire W and the gripping unit 11 are provided on the lower surface 10*e* side of the main body 10, the center of gravity C of the reinforcing bar binding machine 1D is located below the main body 10, more specifically, near the magazine 2. Therefore, when such a reinforcing bar binding machine 1D is hooked on the reinforcing bar S or the like via the first hook 200A attached to the hook attachment unit 210*a* to 210*e*, due to the relationship with the position of the center of gravity, the reinforcing bar binding machine 1D does not become significantly tilted (moved) and unstable, and can be stably held. That is, since the reinforcing bar binding machine 1D is stably hooked on the reinforcing bar S or the like, problems such as the reinforcing bar binding machine 1D falling from the reinforcing bar are less likely to occur. Further, the hook 200A is attached to the hook attachment unit 210*a* to 210*e* so that the hook 200A is located on the upper surface 10*a* side of the main body 10, and the opening 201 of the hook 200A faces the front side. Therefore, when the hook 200A is attached to the hook attachment unit 210*a* to 210*e*, after the binding work to the reinforcing bar S located in front of the worker, the worker can hook the reinforcing bar binding machine 1D on the reinforcing bar S with a small number of movements while tilting the front end side of the main body 10 having the curl forming unit 5 downward and without turning over his wrist. In this way, when the reinforcing bar binding machine 1D is repeatedly used and hooked when not in use, the work efficiency can be improved and the work load on the worker can be reduced.

Fifth Embodiment

In a reinforcing bar binding machine 1E according to a fifth embodiment, a hook attachment unit 310 is provided only on the left surface 10*b* side of the main body 10. Meanwhile, the components having substantially the same function as the reinforcing bar binding machine 1A according to the above-mentioned embodiment are designated by the same reference numerals, and duplicate description will be omitted.

Figure 14:
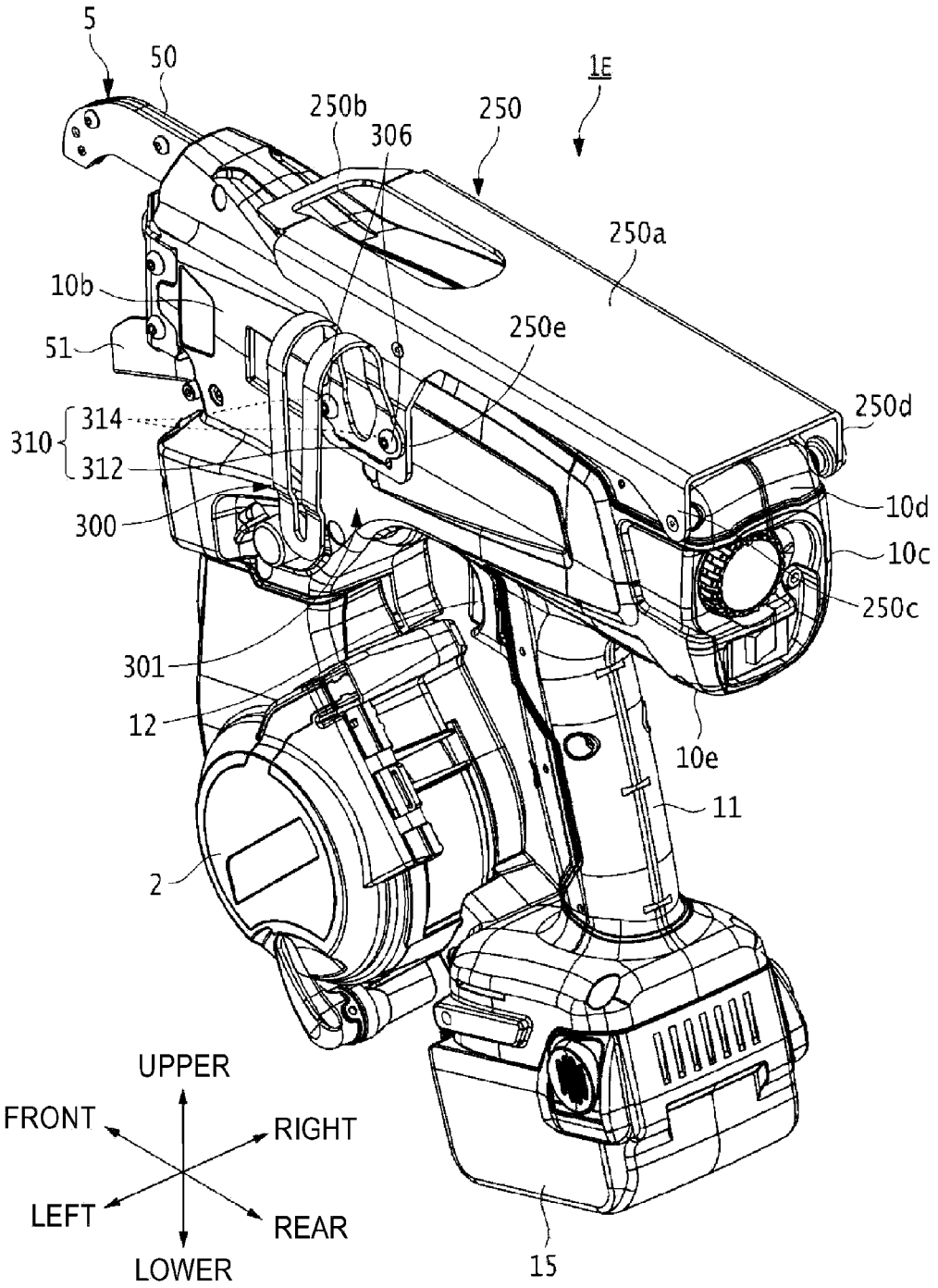
FIG. 14 is a perspective view of a reinforcing bar binding machine according to a fifth embodiment as viewed from the rear side of the left surface.

FIG. 14 is a perspective view of the reinforcing bar binding machine 1E according to the fifth embodiment as viewed from the rear side of the left surface.

As shown in FIG. 14, the reinforcing bar binding machine 1E includes the main body 10, the binding unit 4 having the curl forming unit 5 and the twisting unit 7 is provided on the front end portion in the longitudinal direction of the main body 10, and the driving unit 8 for driving the binding unit 4 is accommodated inside the main body 10 (see FIG. 4). The reinforcing bar binding machine 1E includes the magazine 2 provided on the lower surface 10*e* side of the main body 10 and configured to accommodate the wire W so that the wire W can be sent out, the gripping unit 11 provided on the lower surface 10*e* side of the main body 10 and on the rear side of the magazine 2, and the hook attachment unit 310 located on the left surface 10*b* side of the main body 10 and to which the U-shaped hook 300 opened at one side can be attached. Although, in the present embodiment, the hook 300 is configured to have a U-shape on the side surface, the hook 300 does not necessarily have to be U-shaped, and may be, for example, J-shaped, L-shaped, inverted C-shaped, or crank-shaped.

The hook attachment unit 310 is provided on the overhang portion 250*e* of the cover unit 250. The hook 300 is attached to the hook attachment unit 310 so that the opening 301 of the hook 300 faces the center of gravity C of the reinforcing bar binding machine 1E (see FIG. 3). Further, the hook 300 is attached to the hook attachment unit 310 so that the opening 301 of the hook 300 faces the lower side in the upper and lower direction of the main body 10. Meanwhile, as shown in FIG. 7 and the like, a plurality of hook attachment units 310 may be provided, or the hook attachment unit 310 may be provided directly on the left surface 10*b* of the main body 10. Further, the hook attachment unit 310 may be provided on the right surface 10*c* side of the main body 10, or may be provided on both the left surface 10*b* and the right surface 10*c* of the main body 10.

As described above, since the reinforcing bar binding machine 1E of the fifth embodiment is configured so that the magazine 2 for accommodating the wire W and the gripping unit 11 are provided on the lower surface 10*e* side of the main body 10, the center of gravity C of the reinforcing bar binding machine 1E is located below the main body 10, more specifically, near the magazine 2. Therefore, when such a reinforcing bar binding machine 1E is hooked on the reinforcing bar S or the like via the second hook 300 attached to the hook attachment unit 310, due to the relationship with the position of the center of gravity, the reinforcing bar binding machine 1E does not become significantly tilted (moved) and unstable, and can be stably held. That is, since the reinforcing bar binding machine 1E is stably hooked on the reinforcing bar S or the like, problems such as the reinforcing bar binding machine 1E falling from the reinforcing bar S or the like are less likely to occur. Further, the hook 300 is attached to the hook attachment unit 310 so that the hook 300 is located on the left surface 10*b* side of the main body 10, and the opening 301 of the hook 300 faces the lower side. Therefore, when the reinforcing bar binding machine 1E is hooked on the reinforcing bar S or the like, the reinforcing bar binding machine 1E is held so that the left surface 10*b* in the front and rear direction of the main body 10 is substantially parallel to the reinforcing bar S or the like. Therefore, the amount of protrusion of the main body 10 with respect to the reinforcing bar S or the like can be reduced, and even when the reinforcing bar binding machine 1E is hooked on the reinforcing bar S, the reinforcing bar binding machine 1E does not interfere with the work, and smooth movement and work can be performed at the work site.

Sixth Embodiment

A reinforcing bar binding machine 1F according to a sixth embodiment is different from the reinforcing bar binding machine 1A of the first embodiment in that the magazine 2 is provided on the side surface side of the main body 10. Meanwhile, the components having substantially the same function as the reinforcing bar binding machine 1A according to the above-mentioned embodiment are designated by the same reference numerals, and duplicate description will be omitted.

Figure 15:
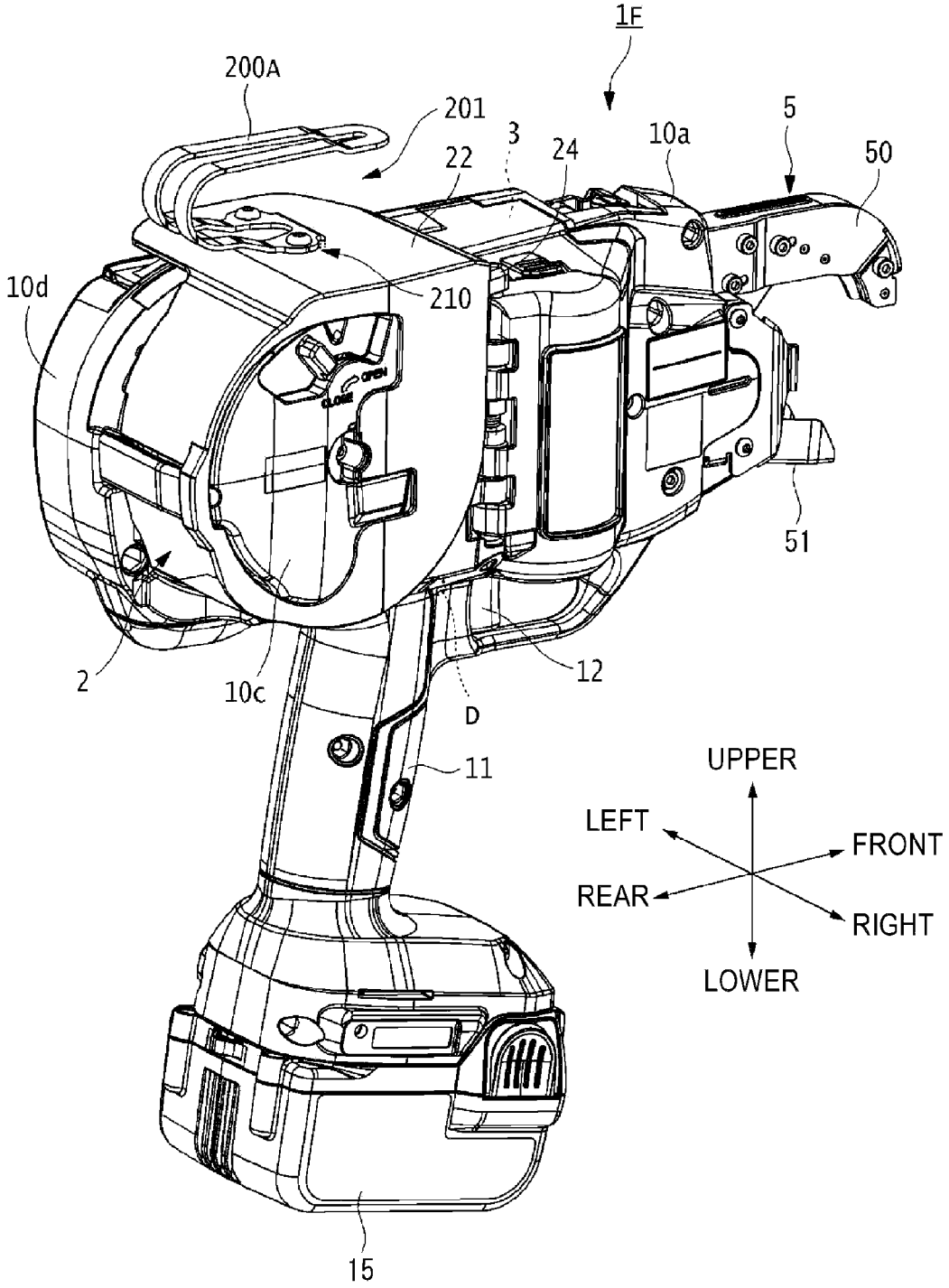
FIG. 15 is a perspective view of a reinforcing bar binding machine according to a sixth embodiment as viewed from the rear side of the right surface.

FIG. 15 is a perspective view of the reinforcing bar binding machine 1F according to the sixth embodiment as viewed from the rear side of the right surface.

As shown in FIG. 15, the reinforcing bar binding machine 1F includes the main body 10, the binding unit 4 having the curl forming unit 5 and the twisting unit 7 is provided on the front end portion in the longitudinal direction of the main body 10, and the driving unit 8 (see FIG. 4) for driving the binding unit 4 is accommodated inside the main body 10 (see FIG. 4). The reinforcing bar binding machine 1F includes the magazine 2 provided on the rear end portion in the front and rear direction of the main body 10 and configured to accommodate the wire W so that the wire W can be sent out, and the gripping unit 11 provided on the lower surface 10*e* side of the main body 10.

Further, the reinforcing bar binding machine 1F includes the hook attachment unit 210 located on the upper surface 10*a* side of the main body 10 and to which the U-shaped first hook 200A opened at one side can be attached. Although, in the present embodiment, the first hook 200A is configured to have a U-shape on the side surface, the first hook 200A does not necessarily have to be U-shaped, and may be, for example, J-shaped, L-shaped, inverted C-shaped, or crank-shaped.

The magazine 2 is provided at a position closer to the right surface 10*c* side of the main body 10 in order to avoid the twisting unit 7 and the driving unit 8 and the like arranged on the left side inside the main body 10. The magazine 2 is configured by a space portion that can accommodate the reel 20 around which the wire W is wound.

Further, as shown in FIG. 15, a magazine cover unit 22 capable of opening and closing the space of the magazine 2 is provided on the rear side of the main body 10. The magazine cover unit 22 is attached to a support shaft 24 provided on the upper surface 10*a* of the main body 10 and is configured to be pivotable around the support shaft 24 as a fulcrum between a position where the magazine 2 is closed and a position where the magazine 2 is opened.

The first hook attachment unit 210 is provided on the upper surface of the magazine cover unit 22. The first hook 200A is attached to the first hook attachment unit 210 so that the opening 201 of the first hook 200A faces the front side in the front and rear direction of the main body 10. The first hook 200A is attached to the magazine cover unit 22 by fitting the engaging piece 202 (see FIG. 2) into the engaging hole 212 formed in the magazine cover unit 22 and screwing the screw 206 into the screw hole 214 formed in the magazine cover unit 22 via the insertion hole 204 (see FIG. 2).

Meanwhile, as described in the first embodiment, a plurality of first hook attachment units 210 may be provided, or the first hook attachment unit 210 may be provided directly on the upper surface 10*a* of the main body 10. Further, as shown in FIG. 8A and the like, the first hook 200A may be attached to the first hook attachment unit 210 so that the first hook 200A is movable from the upper surface 10*a* side of the main body 10 to the rear surface 10*d* side. Furthermore, as shown in FIG. 10 and the like, the first hook 200A may be attached to the first hook attachment unit 210 so that the first hook 200A is movable from the upper surface 10*a* side of the main body 10 to at least one surface side of the left surface 10*b* side and the right surface 10*c* side.

Further, as described in the first embodiment and the like, the second hook attachment unit 310 may be provided on at least one surface side of the left surface 10*b* and the right surface 10*c* of the main body 10. In this case, when the main body 10 is viewed from the front (front view), the second hook 300 is attached to the second hook attachment unit 310 so that the second hook 300 does not block the opening 201 of the first hook 200A attached to the first hook attachment unit 210. Further, the second hook 300 is attached to the second hook attachment unit 310 so that the second hook 300 does not protrude from the upper surface 10*a* of the main body 10 or the magazine cover unit 22.

Further, the second hook 300 is attached to the second hook attachment unit 310 so that the opening 301 of the second hook 300 is located on the lower side in the front and rear direction of the reinforcing bar binding machine 1F and faces a center of gravity D of the reinforcing bar binding machine 1F. Here, the center of gravity D of the reinforcing bar binding machine 1F is determined by the weights of the main body 10, the curl forming unit 5, the magazine 2, the gripping unit 11, the battery 15 and the like, and the arrangement thereof. In the present embodiment, since the magazine 2 which is one of heavy objects is provided on the rear end portion in the front and rear direction of the main body 10, the magazine 2 is located slightly behind the trigger 12 and is located at a connecting portion between the lower surface 10*e* of the main body 10 and the upper end portion of the gripping unit 11.

As described above, since the reinforcing bar binding machine 1F of the sixth embodiment is configured so that the magazine 2 is located at the rear end portion in the front and rear direction of the main body 10, the center of gravity D of the reinforcing bar binding machine 1F is located near the magazine 2. Therefore, when such a reinforcing bar binding machine 1F is hooked on the reinforcing bar S or the like via the hook 200A attached to the hook attachment unit 210, due to the relationship with the position of the center of gravity, the reinforcing bar binding machine 1F does not become significantly tilted (moved) and unstable, and can be stably held. That is, since the reinforcing bar binding machine 1F is stably hooked on the reinforcing bar S or the like, problems such as the reinforcing bar binding machine 1F falling from the reinforcing bar S or the like are less likely to occur.

Further, according to the reinforcing bar binding machine 1F, the hook 200A is attached to the hook attachment unit 210 so that the hook 200A is located on the upper surface 10*a* side of the main body 10, and the opening 201 of the hook 200A faces the front side. Therefore, when the hook 200A is attached to the hook attachment unit 210, after the binding work to the reinforcing bar S or the like located in front of the worker, the worker can hook the reinforcing bar binding machine 1F on the reinforcing bar S or the like with a small number of movements while tilting the front end side of the main body 10 having the curl forming unit 5 and the like downward and without turning over his wrist. Therefore, when the reinforcing bar binding machine 1F is repeatedly used and hooked when not in use, the work efficiency can be improved and the work load on the worker can be reduced.

Although the preferred embodiments of the disclosure have been described in detail with reference to the accompanying drawings, the technical scope of the disclosure is not limited to such examples. For example, although the above-mentioned embodiments have described the case where the tool is the reinforcing bar binding machine 1A or the like, the example of the tool includes a nailing machine and a screw fastener and the like, in addition to the reinforcing bar binding machine 1A or the like. The hook attachment unit described above can also be applied to a nailing machine and a screw fastener and the like.

In the above-mentioned embodiments, the first hook attachment unit 210*a* and the like are configured by the engaging hole 212*a* into which the engaging piece 202 of the first hook 200A is fitted, and the screw hole 214*a* into which the screw 206 is screwed. However, the disclosure is not limited to such configurations. For example, a known fastening means such as a fitting type may be applied instead of the screw fastening. Further, the same applies to the other second hook attachment unit 310 and the like described in the above-mentioned embodiments.

<Additional Notes>

This application discloses at least the following inventions (1) to (18).

(1) A tool includes: a main body including an output section provided on a front end portion in a longitudinal direction and accommodating a driving unit for driving the output section therein; a gripping unit provided on a lower surface side of the main body; a first hook attachment unit located on an upper surface side of the main body and configured to allow a hook opened at one side attached; and a second hook attachment unit located on a side surface side of the main body and configured to allow the hook attached. The hook is attached to the first hook attachment unit so that an opening of the hook faces the front side in the longitudinal direction of the main body. The hook is attached to the second hook attachment unit so that the opening of the hook faces the lower side in an upper and lower direction of the main body.

According to the tool of the disclosure, the hook is attached to the first hook attachment unit so that the hook is located on the upper surface side of the main body, and the opening of the hook faces the front side. Therefore, when the hook attached to the first hook attachment unit is hooked on a hooked member such as a reinforcing bar, a wall or a pillar located in front of a worker, a worker can hook the hook on the hooked member with a small number of movements while tilting the front end side of the main body having the output section downward and without turning over his wrist. Therefore, when the tool is repeatedly used and hooked when not in use, the work efficiency can be improved and the work load on the worker can be reduced.

Further, the hook is attached to the second hook attachment unit so that the hook is located on the side surface side of the main body, and the opening of the hook faces the lower side. Therefore, when the tool is hooked on a hooked member such as a reinforcing bar or a wall, the tool is held so that the side surface in the longitudinal direction of the main body is substantially parallel to the reinforcing bar or the wall or the like. In this way, the amount of protrusion of the main body with respect to the hooked member can be reduced, and even when the tool is hooked on the hooked member, the tool does not interfere with the work, and smooth movement and work can be performed at the work site.

Further, since the first hook attachment unit and the second hook attachment unit having the above-mentioned effects are provided in one tool, the work efficiency can be improved and the work load on the worker can be reduced in various situations at various work sites.

(2) The tool according to (1), where in a case where the main body is viewed from the front, the hook is attached to the second hook attachment unit so that the hook does not block the opening of the hook attached to the first hook attachment unit.

(3) The tool according to (1) or (2), where the hook is attached to the second hook attachment unit so that the hook does not protrude from the upper surface of the main body.

(4) The tool according to any one of (1) to (3), where the hook is attached to the second hook attachment unit so that the opening of the hook faces a center of gravity of the tool.

(5) The tool according to any one of (1) to (4), where the hook is attached to the first hook attachment unit so that the hook is movable from the upper surface side of the main body to the side surface side.

(6) The tool according to any one of (1) to (5), where the hook is attached to the first hook attachment unit so that the hook is movable from the upper surface side of the main body to the rear surface side.

(7) The tool according to any one of (1) to (6), further includes a cover unit provided on the upper surface side of the main body along the longitudinal direction and including a guide surface for guiding a hooked member to the opening of the hook attached to the first hook attachment unit.

(8) The tool according to (7), where the cover unit has an inclined surface that inclines from the front to the rear in the longitudinal direction.

(9) The tool according to (7) or (8), where the first hook attachment unit is provided on the cover unit.

(10) The tool according to (9), where the cover unit includes a plurality of first hook attachment units along the longitudinal direction.

(11) A binding machine includes: a main body including a binding unit for binding a wire provided on a front end portion in a longitudinal direction and accommodating a driving unit for driving the binding unit therein; an accommodation unit provided on a lower surface side of the main body and accommodating the wire, the accommodation unit configured to send out the wire; a gripping unit provided on the lower surface side of the main body and on the rear of the accommodation unit; and a hook attachment unit located on an upper surface side of the main body and configured to allow a hook opened at one side attached. The hook is attached to the hook attachment unit so that an opening of the hook faces the front side in the longitudinal direction of the main body.

Since the first binding machine of the disclosure is configured so that the accommodation unit for accommodating the wire and the gripping unit are provided on the lower surface side of the main body, the center of gravity of the binding machine is located below the main body, more specifically, near the accommodation unit. Therefore, when such a binding machine is hooked on a hooked member such as a reinforcing bar via the hook attached to the hook attachment unit, due to the relationship with the position of the center of gravity, the binding machine does not become significantly tilted (moved) and unstable, and can be stably held. That is, since the binding machine is stably hooked on the hooked member, problems such as the binding machine falling from the reinforcing bar are less likely to occur. Further, the hook is attached to the hook attachment unit so that the hook is located on the upper surface side of the main body, and the opening of the hook faces the front side. Therefore, when the hook is attached to the hook attachment unit, after the binding work to the reinforcing bar located in front of the worker, the worker can hook the binding machine on the reinforcing bar (hooked member) with a small number of movements while tilting the front end side of the main body having the binding unit downward and without turning over his wrist. In this way, when the binding machine is repeatedly used and hooked when not in use, the work efficiency can be improved and the work load on the worker can be reduced.

(12) A binding machine includes: a main body including a binding unit for binding a wire provided on a front end portion in a longitudinal direction and accommodating a driving unit for driving the binding unit therein; an accommodation unit provided on a lower surface side of the main body and accommodating the wire, the accommodation unit configured to send out the wire; and a gripping unit provided on the lower surface side of the main body and on the rear of the accommodation unit. The binding machine includes a hook attachment unit located on a side surface side of the main body and configured to allow a hook opened at one side attached. The hook is attached to the hook attachment unit so that an opening of the hook faces a center of gravity of the binding machine.

Since the second binding machine of the disclosure is configured so that the accommodation unit for accommodating the wire and the gripping unit are provided on the lower surface side of the main body, the center of gravity of the binding machine is located below the main body, more specifically, near the accommodation unit. Therefore, when such a binding machine is hooked on a hooked member such as a reinforcing bar via the hook attached to the hook attachment unit, due to the relationship with the position of the center of gravity, the binding machine does not become significantly tilted (moved) and unstable, and can be stably held. That is, since the binding machine is stably hooked on the hooked member, problems such as the binding machine falling from the reinforcing bar are less likely to occur. Further, the hook is attached to the hook attachment unit so that the hook is located on the side surface side of the main body, and the opening of the hook faces the lower side. Therefore, when the binding machine is hooked on a hooked member such as a reinforcing bar or a wall, the binding machine is held so that the side surface in the longitudinal direction of the main body is substantially parallel to the reinforcing bar or the wall or the like. In this way, the amount of protrusion of the main body with respect to the hooked member can be reduced, and even when the binding machine is hooked on the hooked member, the binding machine does not interfere with the work, and smooth movement and work can be performed at the work site.

(13) The binding machine according to (12), where the hook is attached to the hook attachment unit so that the opening of the hook faces the lower side in an upper and lower direction of the main body.

(14) A binding machine includes: a main body including a binding unit for binding a wire provided on a front end portion in a longitudinal direction and accommodating a driving unit for driving the binding unit therein; an accommodation unit provided on a rear end portion in the longitudinal direction of the main body and accommodating the wire, the accommodation unit configured to send out the wire; a gripping unit provided on a lower surface side of the main body; and a hook attachment unit located on an upper surface side of the main body and configured to allow a hook opened at one side attached. The hook is attached to the hook attachment unit so that an opening of the hook faces the front side in the longitudinal direction of the main body.

According to the third binding machine of the disclosure, the hook is attached to the hook attachment unit so that the hook is located on the upper surface side of the main body, and the opening of the hook faces the front side. Therefore, when the hook is attached to the hook attachment unit, after the binding work to the reinforcing bar located in front of the worker, the worker can hook the binding machine on the reinforcing bar (hooked member) with a small number of movements while tilting the front end side of the main body having the binding unit downward and without turning over his wrist. In this way, when the binding machine is repeatedly used and hooked when not in use, the work efficiency can be improved and the work load on the worker can be reduced.

(15) The binding machine according to (11), where the hook is attached to the hook attachment unit so that the hook is movable from the upper surface side of the main body to a side surface side.

(16) The binding machine according to (14), further includes: an other hook attachment unit located on a side surface side of the main body and configured to allow an other hook attached.

(17) The binding machine according to (16), where, in a case where the main body is viewed from the front, the other hook is attached to the other hook attachment unit so that the other hook does not block the opening of the hook attached to the hook attachment unit.

(18) The binding machine according to (16), where the other hook is attached to the other hook attachment unit so that the opening of the other hook faces a center of gravity of the binding machine.

The invention claimed is:

1. A tool comprising:

a main body including an output section provided on a front end portion in a longitudinal direction and accommodating a driving unit for driving the output section therein;

a gripping unit provided on a lower surface side of the main body;

a first hook including two end portions each of which is disposed on one side and another side respectively via a first opening, and a first hooking portion continuously connecting the two end portions, a first hook attachment unit located on an upper surface side of the main body and configured to allow the first hook to be attached;

a second hook including two end portions each of which is disposed on one side and another side respectively via a second opening, and a second hooking portion continuously connecting the two end portions;

a second hook attachment unit located on a side surface side of the main body and configured to allow the second hook to be attached; and a cover unit provided on the upper surface side of the main body along the longitudinal direction, and including a guide surface for guiding a hooked member to the first opening of the first hook attached to the first hook attachment unit and an inclined surface that inclines from a front to a rear in the longitudinal direction, wherein one of the two end portions of the first hook is fixed to the cover unit, and another of the two end portions of the first hook is disposed apart from the cover unit, wherein the first hook is attached to the first hook attachment unit so that the first hooking portion is disposed on a rear side in the longitudinal direction of the main body and the first opening of the first hook is disposed on a front side in the longitudinal direction of the main body, wherein one of the two end portions of the second hook is fixed to the main body, and another of the two end portions of the second hook is disposed apart from the main body, and wherein the second hook is attached to the second hook attachment unit so that the second hooking portion and the second opening of the second hook are disposed on a lower side in an upper and lower direction of the main body.

2. The tool according to claim 1, wherein, in a case where the main body is viewed from the front, the second hook is attached to the second hook attachment unit so that the second hook does not block the opening of the first hook attached to the first hook attachment unit.

3. The tool according to claim 1, wherein the second hook is attached to the second hook attachment unit so that the second hook does not protrude from the upper surface side of the main body.

4. The tool according to claim 1, wherein the second hook is attached to the second hook attachment unit so that the opening of the second hook faces a center of gravity of the tool.

5. The tool according to claim 1, wherein the first hook is attached to the first hook attachment unit so that the first hook is movable from the upper surface side of the main body to the side surface side.

6. The tool according to claim 1, wherein the first hook is attached to the first hook attachment unit so that the first hook is movable from the upper surface side of the main body to a rear surface side.

7. The tool according to claim 1.

wherein the first hook attachment unit is provided on the cover unit.

8. The tool according to claim 7, wherein the cover unit includes a plurality of first hook attachment units along the longitudinal direction.

* * * * *